United States Patent [19]

Constant

[11] 4,187,000

[45] Feb. 5, 1980

[54] ADDRESSABLE OPTICAL COMPUTER AND FILTER

[76] Inventor: James N. Constant, 1603 Danbury Dr., Claremont, Calif. 91711

[21] Appl. No.: 860,725

[22] Filed: Dec. 15, 1977

Related U.S. Application Data

[63] Continuation-in-part of Ser. No. 587,323, Jun. 16, 1975, abandoned.

[51] Int. Cl.[2] ..... G06G 9/00

[52] U.S. Cl. ..... 350/162 SF; 350/3.62; 350/3.70; 364/820; 364/822; 365/215

[58] Field of Search ..... 350/3.62, 3.70, 162 SF, 350/DIG. 1; 364/819, 820, 822; 365/215, 216

[56] References Cited

U.S. PATENT DOCUMENTS

| | | | |
|---|---|---|---|
| 3,510,223 | 5/1970 | Lohmann | 350/162 SF |
| 3,542,452 | 11/1970 | Gerritsen et al. | 350/3.62 |
| 3,555,455 | 1/1971 | Richards et al. | 331/94.5 |
| 3,572,878 | 3/1971 | Sun Lu | 350/162 SF |
| 4,097,749 | 6/1978 | Gardner | 350/162 SF X |

FOREIGN PATENT DOCUMENTS

| | | | |
|---|---|---|---|
| 1233007 | 5/1971 | United Kingdom | 350/162 SF |

OTHER PUBLICATIONS

Roth, "Effective Measurements Using Digital Signal Analysis," *IEEE Spectrum,* vol. 8, No. 4, Apr. 1971, pp. 62–70.

Stroke, "Optical Computing," *IEEE Spectrum,* vol. 9, No. 12, Dec. 1972, pp. 24–41.

Wai-Hon Lee et al., "Matched Filter Optical Processor," *Applied Optics,* vol. 13, No. 4, Apr. 1974, pp. 925–930.

*Primary Examiner*—John K. Corbin
*Assistant Examiner*—John D. Lee
*Attorney, Agent, or Firm*—Harris, Kern, Wallen & Tinsley

[57] ABSTRACT

The disclosure describes method and apparatus for optically computing the impulse response h, transfer function H, coherence function $\gamma$, impulse coherence $\Gamma$, product $S_yH_r$, division $1/S_x$, cross-correlation $R_{yx}$, cross-power spectrum $G_{yx}$, complex conjugate $S_x^*$, and convolution y*x of signals y and x in real time. The method comprises the steps of computing the mathematical function of a given parameter. The apparatus of the invention comprises the realization of optical elements for performing the tasks of the method.

54 Claims, 15 Drawing Figures

FIG. 1A.
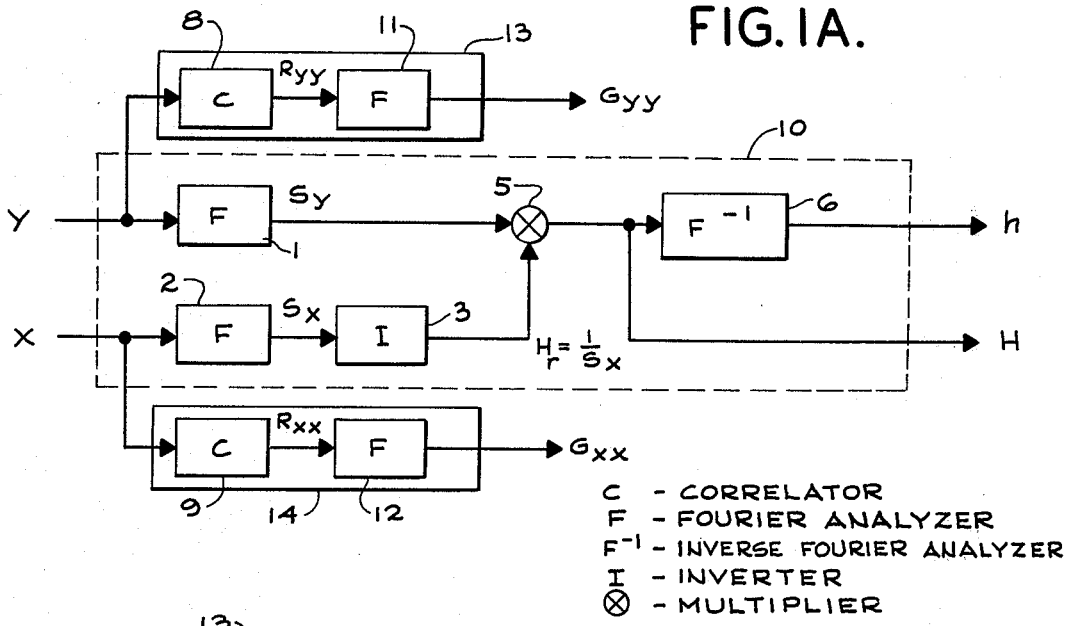
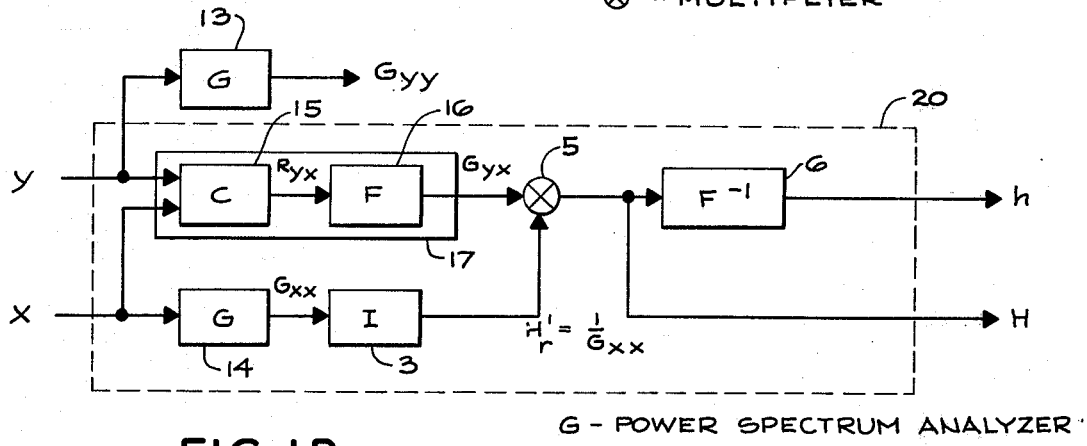
FIG. 1B.
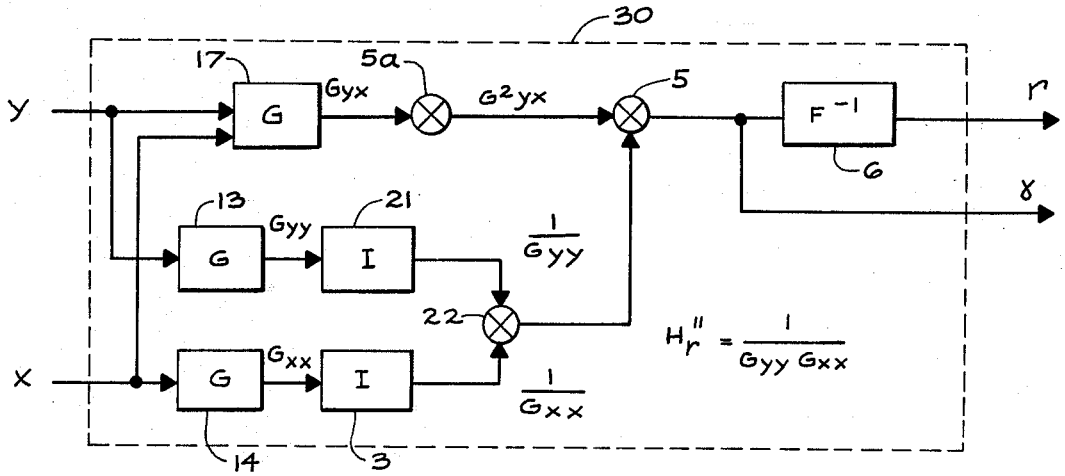
FIG. 1C.

FIG. 3A.
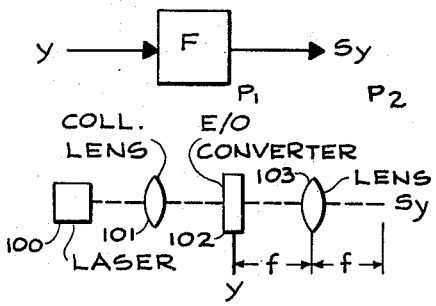
FIG. 3E.
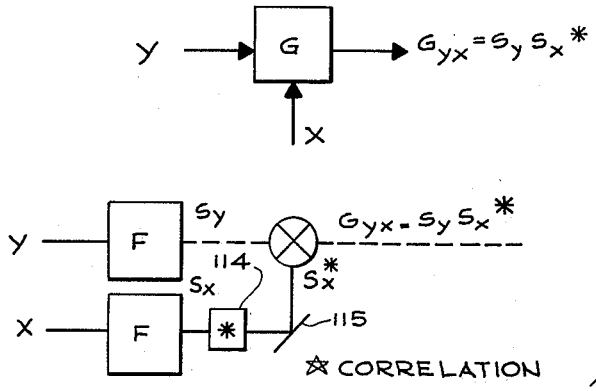
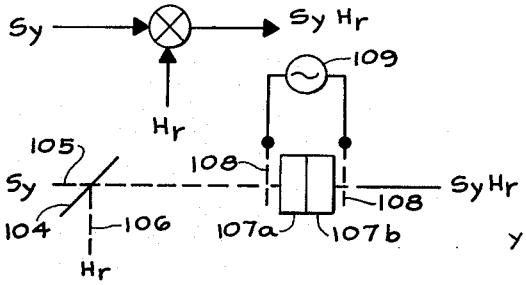
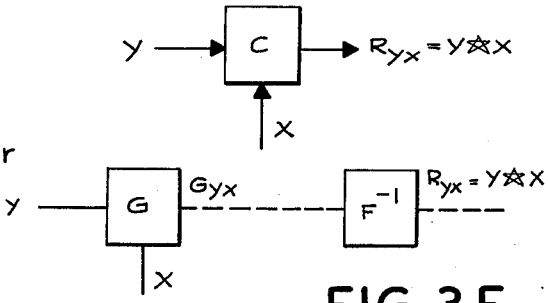
FIG. 3F.
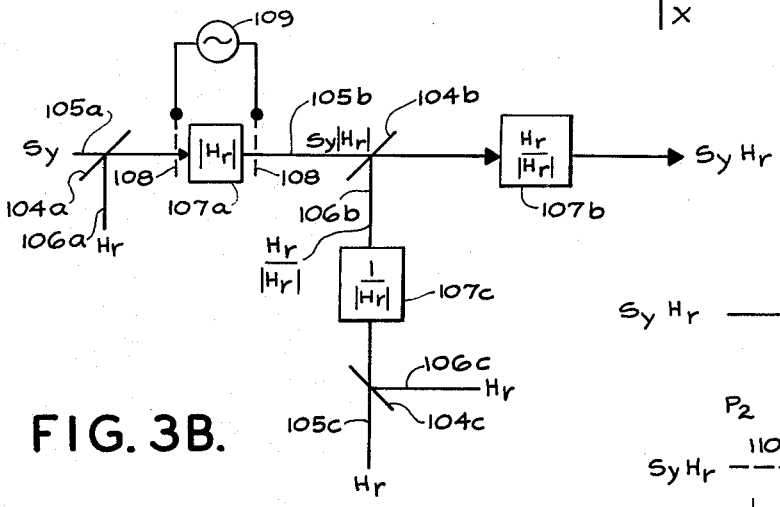
FIG. 3B.
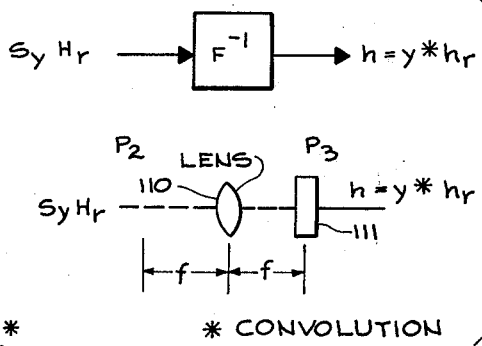
FIG. 3C.
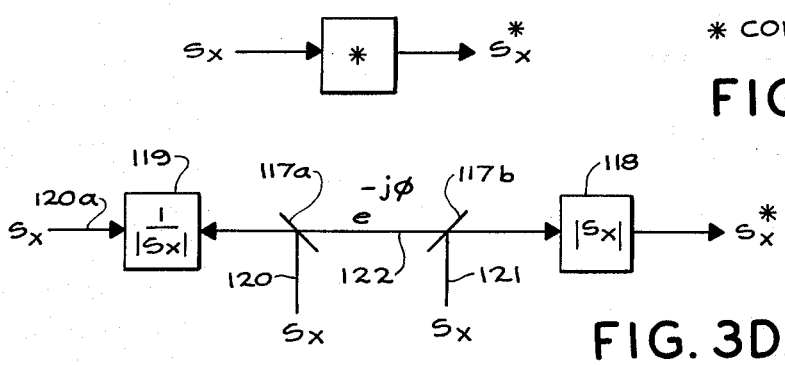
FIG. 3D.

$S_x$
I
$\frac{1}{S_x}$
112
113
$S_x^*$
NL
CONJUGATE TRANSFORMER
NEGATIVE NON-LINEAR ELEMENT
$S_y$
÷
$\frac{S_y}{S_x}$
124
125
128
130
123a
123b
$\frac{1}{|S_x|}$
$\frac{S_y}{|S_x|}$
$e^{-j\phi}$
129a
129b
127
126
123d
123c y
CV
$h = y * h_r$
$h_r$
E/O CONVERTER
O/O CONVERTER
LENS
O/E CONVERTER
$S_y H_r$
102
103
131
110
111
f
MULTIPLIER
INTEGRATOR
$yh_r$
132
133
$h_r(x_1', y_1')$
SHIFT MEANS
134

ADDRESSABLE OPTICAL COMPUTER AND FILTER

CROSS REFERENCE TO RELATED APPLICATION

This application is a continuation-in-part of my copending application Ser. No. 587,323, filed June 16, 1975, now abandoned.

BACKGROUND OF THE INVENTION

The present invention relates to optical computers implemented as matched clutter filters, multipliers, dividers, correlators, power spectrum analyzers, conjugate transformers, convolvers and optical computers which compute the impulse response h, transfer function H, coherence function $\gamma$, impulse coherence $\Gamma$, product $S_yH_r$, inversion $1/S_x$, division $S_y/S_x$, cross-correlation $R_{yx}$, cross-power spectrum $G_{yx}$, complex conjugate $S_x^*$ and convolution $y^*x$ of two signals y and x in real time. The signals y and x may be one or two dimensional signals in a radar, sonar, communications system, mapping, surveillance, reconnaissance or pattern recognition system.

The Fourier transforms F of signals y and x are given by $$S_y=F\{y\} \qquad S_x=F\{x\} \tag{1}$$

from which three power spectra and corresponding time correlations may be computed. There are the cross and auto power spectra and correlations $$\begin{aligned} G_{yx} &= S_yS_x^* & R_{yx} &= F^{-1}\{G_{yx}\} \\ G_{yy} &= S_yS_y^* & R_{yy} &= F^{-1}\{G_{yy}\} \\ G_{xx} &= S_xS_x^* & R_{xx} &= F^{-1}\{G_{xx}\} \end{aligned} \tag{2}$$

where the asterisk appearing over a quantity indicates a complex conjugate and $F^{-1}$ is the inverse Fourier transform of the quantity indicated. The correlations and their Fourier transforms are given by $$\begin{aligned} R_{yx} &= \int y(t)\, x(t+\tau)dt & G_{yx} &= F\{R_{yx}\} \\ R_{yy} &= \int y(t)\, y(t+\tau)dt & G_{yy} &= F\{R_{yy}\} \\ R_{xx} &= \int x(t)\, x(t+\tau)dt & G_{xx} &= F\{R_{xx}\} \end{aligned} \tag{3}$$

Signal x is related to the signal y by the transfer function H and impulse response h $$H = \frac{S_y}{S_x} = \frac{G_{yx}}{G_{xx}} \qquad h = F^{-1}\{H\} \tag{4}$$

In the foregoing the impulse response h and transfer function H are equivalent statements in the time and frequency domains of the relationships between the signals y and x, for example as the received and transmitted signals of a radar or communication system or as the output and input of a system under test. In some applications, however, the measurement desired is not the relationship between signals but the causality between signals. This type measurement is obtained by computing the coherence function and impulse coherence given by $$\gamma = \frac{G_{yx}^2}{G_{yy}G_{xx}} \qquad \Gamma = F^{-1}\{\delta\} \tag{5}$$

where $\gamma$ is a value lying between 0 and 1. In view of equations (4), equations (5) can also be written as follows:

$$\gamma = \frac{H^2G_{xx}}{G_{yy}} \qquad \Gamma = F^{-1}\{\delta\} \tag{6}$$

which provides an alternative method for computing the coherence function.

It is well known in the radar and communications arts that the output of a filter $S_{yo}$ is related to its input by the filter's transfer function $H_r$ $$S_{yo}=S_yH_r=G_{yx}H_r',\ H_r=S_x^*H_r' \tag{7}$$

where $S_{yo}$ and $S_y$ represent the frequency spectra of the output signal $y_o$ and input signal y respectively. The $G_{yx}H_r'$ part of equation (7) is obtained by virtue of the fact that $G_{yx}=S_yS_x^*$.

The output signal $y_o$ may be obtained using any one of the following algorithms:

$$\begin{aligned} y_o &= \int y(t)\, h_r(t-\tau)\, dt = \int R_{yx}(t)\, h'_r(t-\tau)\, dt \\ y_o &= F^{-1}\{S_yH_r\} = F^{-1}\{G_{yx}H'_r\} \\ y_o &= \int a(t)\, y(t-\tau)\, dt - \int b(t)\, y_o(t-\tau)\, dt \end{aligned} \tag{8}$$

where the integrals are over all times. Thus the output of a filter can be obtained in any one of a number of ways; by direct use of the convolution integral in the first of equations (8), by the use of equation (7) to obtain the frequency spectrum $S_{yo}$ and then using the inverse Fourier transform in the second of equations (8), or by using the difference (recursive) equations in the last of equations (8). In the present disclosure we will restrict the computations to the first and second of equations (8) and use the terms "convolution integral" and "fast convolution" to distinguish between these two equations. The latter term should not be confused with the like term of the well known Cooley-Tukey method of digital computing but simply to designate the algorithm of the second of equations (8) in the present disclosure. It will be appreciated by those skilled in the optical computer art that the terms "time" and "frequency" although clear enough in the time-frequency domains of most transformations in the communications art will be used in the sense of the spatial distributions encountered in Fourier optics as well.

A filter is said to be matched when the filter transfer function in equation (7) satisfies $$\begin{aligned} H_r &= \frac{S_x^*}{|N|^2} & h_r &= F^{-1}\{H_r\} \\ H'_r &= \frac{1}{|N|^2} & h'_r &= F^{-1}\{H'_r\} \end{aligned} \tag{9}$$

where $|N|^2$ is the power spectrum of the noise or clutter which interferes with the signal y in the filter. The output of a matched filter is obtained by using equation (9) in equation (7)

$$S_{yo} = \frac{G_{yx}}{|N|^2} \qquad y_o = F^{-1}\left\{\frac{G_{yx}}{|N|^2}\right\} \tag{10}$$

Examples of matched filters may be obtained by specifying the power spectrum $|N|^2$ of the interference in equations (9) and (10); when $$\begin{aligned} &|N|^2 = \text{constant} \\ &H_r = S_x^* \qquad H'_r = 1 \\ &S_{yo} = G_{yx} \\ &y_o = R_{yx} \end{aligned} \tag{11}$$

Thus when $|N|^2$=constant, for example thermal noise, the filter is matched for thermal noise when the transfer function $H_r$ is implemented as the complex conjugate $S_x^*$ of the signal x and the filter output represents the cross correlation $R_{yx}$. This is the most familiar case encountered in practice and has been discussed in a number of publications, for example in chapter 9 in the book by Skolnik "Introduction to Radar Systems" McGraw-Hill 1962. Another important case arises when the interference resembles the signal itself, when $$\begin{aligned} &|N|^2 = G_{xx} \\ &H_r = \frac{S_x^*}{G_{xx}} = \frac{1}{S_x} = \frac{G_{yx}}{S_y G_{xx}} \qquad H'_r = \frac{1}{G_{xx}} \\ &S_{yo} = \frac{G_{yx}}{G_{xx}} = \frac{S_y}{S_x} = H \\ &y_o F^{-1}\{H\} = h \end{aligned} \tag{12}$$

Thus when $|N|^2=G_{xx}$, the transfer function $H_r$ can be implemented in one of a number of ways as shown in the second of equations (12) and the filter output represents the impulse response h of signals y and x. This case has been discussed in a number of publications, for example in section 12.4 of Skolnik who describes a matched filter for clutter rejection and in the article by Roth "Effective Measurements Using Digital Signal Analysis" appearing in the April 1971 issue of IEEE Spectrum. Yet another interesting case arises when the interference resembles the combination of signals; when $$\begin{aligned} &|N|^2 = (G_{yy}G_{xx})^{\frac{1}{2}} \\ &H_r = \frac{S_x^*}{(G_{yy}G_{xx})^{\frac{1}{2}}} \qquad H'_r = \frac{1}{(G_{yy}G_{xx})^{\frac{1}{2}}} \\ &S_{yo} = \frac{G_{yx}}{(G_{yy}G_{xx})^{\frac{1}{2}}} = \gamma^{\frac{1}{2}} \\ &y_o = F^{-1}\{\gamma^{\frac{1}{2}}\} \end{aligned} \tag{13}$$

Thus when $|N|^2=(G_{yy}G_{xx})^{\frac{1}{2}}$, the transfer function assumes the form shown in the second of equations (13) and the filter output represents the Fourier transform of the square root of the coherence function $\gamma$. This case has been described by Carter et al "The Smoothed Coherence Transform" appearing in the October 1973 issue of IEEE (Lett) Proceedings. In the present disclosure the term "matched filter" will be used to denote a matched filter for thermal noise for which $|N|^2$=constant while the term "matched clutter filter" will denote a matched filter for clutter for which $|N|^2$ is a function of frequency.

From the foregoing it can be concluded, first, that once the nature of the interference is specified the matched filter is known, second, the filter can be implemented in any one of a number of ways using equations (8) and, third, the matched filter is a non-recursive (zeros only) type filter while the matched clutter filter is a recursive (zeros and poles) type filter. As a consequence, it is to be expected that the matched filter is a simple apparatus based on $R_{yx}$ and $G_{yx}$ while the matched clutter filter is a complex apparatus based on h and H or $\Gamma$ and $\gamma$.

The matched filter based on $R_{yx}$ and $G_{yx}$ is useful in many practical applications especially where there exists little or no interference except thermal noise and signal y almost identically therefore resembles signal x. The matched clutter filter based on h and H is useful when the interference resembles signal x and signal y is a complex signal, for example a group or plurality of closely spaced overlapping signals each signal in the group being almost identical to signal x. The matched clutter filter based on $\Gamma$ and $\gamma$ is useful when the interference resembles the product of signals y and x, for example when both signals y and x have been mixed.

The problem at hand is to obtain a better measurement of the time delay and frequency relationships of signals y and x in a clutter environment. Such measurements are needed in applications involving the arrival of multiple closely spaced and overlapping signals y following transmission of a signal x, for example in radar, sonar, and communications applications and in applications involving the frequency response of a system under test, for example a communication line, an amplifier and so forth. In such applications the measurement of the impulse response h and its transfer function H $$h = \frac{G_{yx}}{G_{xx}} e^{j\omega t} d\omega \qquad H = F\{h\} \tag{14}$$

have better time resolution and frequency response than the cross correlation $R_{yx}$ and its power spectrum $G_{yx}$ $$R_{yx} = \int G_{yx} e^{j\omega t}\, d\omega \qquad G_{yx} = F\{R_{yx}\} \tag{15}$$

The better measurements afforded by equation (14) over equation (15) are obtained by dividing the cross power spectrum $G_{yx}$ by the auto power spectrum $G_{xx}$ or, alternatively in view of equation (4), by dividing the frequency spectrum $S_y$ by the frequency spectrum $S_x$. This is the problem discussed both by Skolnik and Roth. It has also been suggested ad hoc by Carter et al that an even better result is obtained by dividing the cross power spectrum $G_{yx}$ by the square root of the product of auto correlations $(G_{yy}G_{xx})^{\frac{1}{2}}$. As discussed previously, the whitening process of dividing the cross power spectrum $G_{yx}$ by the power spectrum $|N|^2$ of the interference results in a matched filter for the particular type of interference which is being specified in the matching.

The benefits which are to be derived from the measurement of the impulse response h, transfer function H, and coherence function $\gamma$ are threefold; first, it becomes possible to unambiguously determine the time delay between signals even though the signals may have complex shapes and forms, components, codings, close arrival spacings of components and overlappings, second, it becomes possible to accurately determine the performance of a system under test and, third, it becomes possible to determine the effect of noise.

In general, computations of the convolution integral of the first of equations (8) can be made using general purpose digital or analog computers or using special purpose hardware which offer significant savings in computational speeds and costs in a large number of applications. However, while the design of a matched filter involves the relatively simple problem of designing a filter having no poles and only zeros, the corresponding design of a matched clutter filter involves the increasingly difficult problem of designing a filter having both poles and zeros and this reflects directly in the weight, size, power consumption, and cost of both the hardware (analog or digital) and software which may be used. Matched clutter filters are therefore inherently more complex and costly devices when compared to simple matched filters and for this reason are not generally available for mass consumption and use. In fact the design of a matched clutter filter for real time operation becomes almost prohibitive since a large amount of paralleling of elemental hardware building blocks becomes necessary in order to achieve the desired speedup of the signal processing throughput. One feature of the optical computer is its inherent paralleling of a large number of channels. Thus, while non-optical computers increase in size, weight, power consumption, and cost quite rapidly when called upon to simultaneously process a large number of parallel channels the optical computer accomplishes this same task naturally at very high speed and thereby permits the processing of enormous amounts of information and data at the lowest possible cost.

What is important in the decision to implement a matched clutter filter is the accuracy and ambiguity which can be tolerated in the desired result. As example, many applications can be satisfied with a simple matched filter comprising a single correlator and a single Fourier analyzer to obtain the cross correlation $R_{yx}$ and cross power spectrum $G_{yx}$ from which the relationship between signals y and x may be obtained to within some low but tolerable accuracy and ambiguity. If higher accuracy and less ambiguity are desired in the application then a complex matched filter must be implemented comprising perhaps a number of correlators and Fourier analyzers to obtain the impulse response h and transfer function H. In practical terms the desire for higher accuracy and less ambiguity requires the whitening process of dividing the cross power spectrum $G_{yx}$ by the auto power spectrum $G_{xx}$ as discussed in the article by Roth or, in some applications, dividing the cross power spectrum $G_{yx}$ by the square root of the product of auto power spectra $(G_{yy}G_{xx})^{\frac{1}{2}}$ as discussed by Carter et al. Thus the accuracy and ambiguity resolution which is required in a given application will determine the degree and type of whitening which is required in the application and consequently will determine the complexity of the apparatus which is to be used. In general, the measurement of the impulse response h based upon the whitened cross power spectra $G_{yx}/G_{xx}$ or $G_{yx}/(G_{yy}G_{xx})^{\frac{1}{2}}$ is a more complex measurement than is the measurement of the cross correlation $R_{yx}$ based upon the unwhitened cross power spectrum $G_{yx}$ and consequently the apparatus of the matched clutter filter is more complex than that for the matched filter.

Once the selection of the whitening process is made in a given application the problem reduces to the implementation of apparatus having the highest possible speed and lowest possible weight, size, power consumption and cost. In general the transforms represented by equations (8) present an excessive computational load for a general purpose computer and a heavy load even for a digital computer structured for signal processing. For example, a straightforward linear transformation in a computer that takes a sequence of N data points into a sequence of N transform points may be regarded as a multiplication by a vector $N^2$ matrix. A direct implementation therefore requires $N^2$ words of storage and $N^2$ multipliers (simultaneous multiplications). However it is well known that in a correlation or convolution integral one can take advantage of the fast Fourier transform algorithm (FFT) which requires only about $N\log_2 N$ calculations instead of $N^2$ and for N large the time and storage space saved becomes quite significant.

From the foregoing it is clear that making the needed computations using digital computers offers the potential benefit of high speed and high throughput signal processing but while this is easily said it is not easily done. For example, satellite mapping, surveillance and reconnaissance data is routinely collected over vast regions of the earth's surface providing enormous amounts of data that must be analyzed and interpreted. Both tasks have not been completely automated to provide results in real time and are accomplished primarily by skilled analysts and interpreters. The fact is that clutter filters are complex and costly devices and have not found extensive use in practice. Thus while the present art has the potential it has failed to provide a simple and economic method and apparatus for implementing clutter filters, for example for computing the impulse response h, transfer function H, coherence function $\gamma$ and impulse coherence $\Gamma$.

It is a well known fact that the analog computer offers significant advantages in certain fields over the digital computer. For example, the analog computer offers the user low-precision but high-speed one-dimensional or two-dimensional linear discriminant analysis with a significant advantage in hardware performance (equivalent bits per second per dollar) over the digital computer in certain limited but extremely important areas. These areas include fingerprint identification, word recognition, chromosome spread detection, earth-resources and land-use analysis, and broadband radar analysis. In these certain limited cases, defined primarily when the pattern recognition tasks require the correlation detection of features by matched filtering (linear discrimination), it may be advantageous to use the analog computer. The same is true when performing detection by means of quadratic discrimination. In such cases analog computer hardware has a significant speed advantage over most digital hardware. In some cases a considerable cost advantage may also be realized. This is particularly true in the processing of two-dimensional data where optical analog computation may be used to advantage. In addition to analog computers using optical excitation, the electronic analog computer and analog computers using acoustical excitation are well known in the prior art.

Pattern recognition by matched filtering is feasible, using optical analog computation, because of the Fourier relationship which exists between the front and backplanes of a lens. The simplest operation which can be performed by an optical analog computer is the computation of the Fourier transform $S_y(x_x, y_2)$ of an input pattern $y(x_1, y_1)$ where $y(x_1, y_1)$ is the complex signal (amplitude and phase) of the radiation in the front plane $P_1$ of the lens and $S_y(x_2, y_2)$ is the complex Fourier transform of y in the backplane $P_2$ of the lens and where $x_1$, $y_1$ and $x_2$, $y_2$ are spatial coordinates in planes $P_1$ and $P_2$ corresponding to the more familiar time and frequency coordinates encountered more frequently in the non-optical communication art. When the transform $S_y(x_2, y_2)$ is sensed by an energy detector, the result is a measure of the Wiener pattern $G_{yy}(x_2, y_2)=S_y(x_2, y_2) S_y^*(x_2, y_2)$ where $S_y^*$ is the complex conjugate of $S_y$. Only a single lens plus an output detector array is required to construct and record $G_{yy}$. This rather elementary hardware is all that is required for implementing certain simple but very significant pattern recognition tasks including chromosome spread location and remote sensing applications. In addition to computation of the Fourier transform, the optical analog computer may be used for both frequency-domain (plane $P_2$) and time-domain (plane $P_1$) analysis and detection in pattern recognition systems. If, instead of an energy-detector for forming $G_{yy}$, a transparency or other equivalent light modulator is placed in the frequency plane ($P_2$) of the lens and is so structured that it is the estimate for the complex conjugate $S_x^*$ of the transform $S_x$ of a pattern x related to pattern y to be identified then the product $S_yS_x^*$ which is formed in the frequency plane of the lens may be transformed by a second lens to produce the correlation function $R_{yx}(x_3, y_3)$ appearing in the backplane $P_3$ of the second lens. Only two lenses plus an output detector array is required to construct and record $R_{yx}$, i.e., for implementing a correlator or matched filter. And, it will be appreciated that, for implementing a convolver, the direction of inserting transparency $S_x^*$ into the frequency plane must be reversed. This rather elementary hardware is all that is required in implementing certain simple but again significant pattern recognition tasks including character recognition, word recognition and broadband radar signal processing.

The main drawbacks to using optical analog computers are (1) the difficulty of input-output (I/O) conversion, (2) the inaccuracy of the computations and (3) off-line operation.

New devices for solving I/O problems include such input devices as electro-optic delay lines, membrane light modulators, and photochromic films, as well as such output devices as arrays of light detectors and television (TV) pickup tubes. These are well known in the prior art and are discussed extensively in the book by K. Preston "Coherent Optical Computers" New York, McGraw-Hill, 1972 and in the articles by B. Thompson and B. Casasent both appearing in the January 1977 Proceedings IEEE Special Issue on Optical Computing. Selection therefore of such I/O devices will be obvious to those skilled in the art; hence they will not be further discussed here.

Aberrations in the optical system limit the performance of even the most highly corrected and carefully designed optical computers. For this reason, the optical analog computer is useful where low to moderate accuracy of the computations is acceptable but extremely high-speed, high-throughput and precision are required.

The most severe limitation of the optical computer arises from the difficulty of simultaneously controlling the amplitude and phase in the frequency plane in any but a simple pattern. Interferometrically recorded frequency-plane filters while having overcome the simultaneous control of the amplitude and phase are mainly restricted as being off-line, i.e., not in real time.

In practice, the complex quantity $S_x^*(x_2, y_2)$ may not be realized as a photographic transparency in that there is no way of producing the controllable phase modulations required or of recording of the negative values required. The matched filter must, therefore, be made by some other means. This is usually accomplished by holographic techniques where an intensity-only recording medium is placed in the frequency plane of the lens and is illuminated both by the Fourier transform $S_y(x_2,y_2)$ of the pattern to be recognized and by the transform $S_x^*(x_2,y_2)$ of what is called the reference or system function. Thus while the optical computer has the potential it has the serious disadvantage of off-line or two-step holography in which the reference function $S_x^*$ is mechanically recorded for placement in the Fourier or backplane of a lens.

New devices for solving the real-time operation problem include such devices as electro-acoustic, acoustic-optic devices and the electron beam-writing thermoplastic film-recording Lumatron, the von Ardenne tube, electron-beam scan laser, the Titus tube, and other devices. In some cases these devices may also be used to solve the I/O problem. These are well known in the prior art and are discussed in the article by G. Stroke "Optical Computing" appearing in the December, 1972 issue of IEEE Spectrum and in the papers by D. Casasent, H. Weiss, W. Kock, P. Greguss and W. Waidelich, and G. Winzer all appearing in the April, 1975 Special Issue on Optical Computing IEEE Transactions on Computers. Selection thereof of such real-time devices will be obvious to those skilled in the art; hence they will not be further discussed here.

The foregoing advantages and disadvantages of optical computers are well known in the prior art and can be found discussed at length in the article by K. Preston "A Comparison of Analog and Digital Techniques for Pattern Recognition" appearing in the October, 1972 issue of Proceedings of the IEEE, in the article by G. Stroke, and in papers by various authors appearing in the 1975 and 1977 IEEE Special Issues on Computers.

From the foregoing it is clear that the major impediments to the realization of many optical computing devices and systems that exhibit the full throughput and computing power possible in a (parallel) optical computer (processor) have been the realization of workable and economical real-time I/O devices and matched spatial filters capable of operating in real-time. Moreover, the real-time problem when compounded together with the inherent complexity of implementing a clutter filter, whether as an optical device or not, have prevented the optical computer from being considered for many important two-dimensional applications. Its commercial use today is out of the question and it is confined to the laboratory. Clearly, however, the clutter filter excels over the matched filter since it produces the impulse response h while the latter produces the correlation $R_{yx}$ of signals y and x. It will be appreciated that the significance of having an optical computer responding as the impulse response h rather than the correlation $R_{yx}$ is the optical computers high-speed and high-throughput and thereby providing means for processing h over the significantly less demanding computation of $R_{yx}$ and, as a consequence, achieving a signal pattern or picture without ambiguity or blurring. While the prior optical art suggests method and apparatus for implementing an on-line (real time) optical computer using a division filter in the Fourier plane of a lens, i.e., realizing the second of equations (8), this is done using relatively inefficient optical-to-optical (O/O) spatial light modulators (SLMs) and therefore has not succeeded in bringing forth practical and economical optical computers. On the other hand, the prior optical art nowhere suggests method and apparatus for implementing an on-line optical computer by realizing the convolution integral, first of equations (8).

From this discussion it is clear that in the past the implementation of an optical computer for the measurement of the impulse response h, transfer function H, coherence function $\gamma$, and impulse coherence $\Gamma$ has not been attempted being restricted by the realization of even elementary on-line systems and for the inherent complexity of implementing the impulse response h over the lesser complexity of implementing the correlation $R_{yx}$. As a consequence, clutter filters for many demanding and sophisticated signal processing tasks encountered in a variety of applications are only now being attempted using other than optical means and therefore not benefitting from the full potential of optical computation. In all but a few cases do such non-optical means operate on-line. For all practical purposes, although offering the highest speed, throughput, size, weight, power consumption and cost, the optical computer has not been implemented except in simple tasks inside the laboratory and in no case as an on-line clutter filter.

Therefore it is an object of the present invention to provide a method and apparatus for optically computing the impulse response h, transfer function H, coherence function $\gamma$, and impulse coherence $\Gamma$ of a pair of signals y and x in real time.

It is also an object of the invention to provide a method and apparatus for optically computing the correlation $R_{yx}$ and cross power spectrum $G_{yx}$ of a pair of signals y and x in real time.

It is also an object of the invention to provide a method and apparatus for an optical computer based on fast convolution, using the second of equations (8).

It is also an object of the invention to provide a method and apparatus for an optical computer based on the convolution integral, using the first of equations (8).

Within the context of the foregoing objects, it is a special object of the invention to provide a method and apparatus for an efficient optical-to-optical spatial light modulator (SLM) which can be used in the invention filters and computers.

It is a further special object of the invention to provide a method and apparatus for optically computing the multiplication, inversion, complex conjugate, division and convolution of signals in real time.

It is a further special object of the invention to synthesize a number of optical elements capable of performing optical computations in an optical computer in real time.

It is another special object of the invention to provide a method and apparatus for an on-line optical computer which can be operated as a matched filter, matched clutter filter, correlator, and convolver.

It is yet another special object of the invention to illustrate a variety of configurations of an on-line optical computer implemented as a clutter filter.

SUMMARY OF THE INVENTION

This invention provides a method and apparatus for implementing optical computers and filters in real time.

The general purpose of the invention is to provide new and improved on-line optical computers capable of computing the impulse response h, transfer function H, coherence function $\gamma$, and impulse coherence $\Gamma$ of one and two-dimensional signals y and x at high-speeds, high-throughputs, high capacity, high-information content and with efficiency and economy.

Briefly, the invention provides an optical computer for use in real time. The system utilizes the convolution integral or, alternatively, the fast convolution algorithms of a filter, as given by equations (8). The design utilizes conventional optical components which have been assembled to perform the various logical computations in the computer. A key feature suggested by the invention is the use of a sandwiched pair of free-carrier p and n sources with electrodes for performing the on-line amplitude and phase control of a matching filter in the frequency plane of a lens.

Specifically, a voltage is applied to a set of electrodes in a free carrier source and this creates a set of potential wells, for example potential wells in a charge coupled device (CCD). When the free carrier source is illuminated by a recording wavelength within the response band of its material it creates charges, i.e., the free source carriers, and these are confined to locations established by the potential wells. The electrodes can be arrayed in planes and volumes and the potential wells are for holding charges when recording and reproducing surface or volume holograms. Thus, once recorded the free carrier source is illuminated by a reproducing illumination wavelength preferably outside the response band of its material. The recorded illumination is then multiplied by the reproducing illumination in the manner of conventional holography, the difference being the use of the free carrier source replacing the conventional film. In this manner, the invention provides new and improved optical-to-optical (O/O) spatial light modulators (SLMs) for use in a number of filters.

Typically, in one embodiment which uses fast convolution, the filter transfer function $H_r$ is obtained and then multiplied with the frequency spectrum $S_y$ of the input signal y to obtain the transfer function H of signals y and reference signal x. In another embodiment, using the convolution integral, the filter impulse response $h_r$ is obtained and then convolved with the input signal y to obtain the impulse response h of signals y and reference signal x.

It will be appreciated from the foregoing general description that the invention provides a method for optically computing the transfer function H and impulse response h of two signals. It will become apparent later that the invention computes other functions equally well. The method comprises inserting signals y and x into an optical computer, computing the filter's transfer function $H_r$ or its impulse response $h_r$, and using fast convolution to obtain the transfer function H or using the convolution integral to obtain the impulse response h. A method is also provided for computing the filter's transfer function $H_r = S_x^*/|N|^2$, where $|N|^2$ is the spectral intensity of the noise, and for computing the filter's impulse response $h_r = F^{-1} H_r$. The apparatus is equally uncomplicated and straightforward and comprises an optical computer having combinations of simple optical I/O devices, Fourier analyzers, dividers, multipliers, inverse Fourier analyzers, correlators, power spectrum analyzers, convolvers, and conjugate transformers all suitably arranged to perform the computations which are indicated by fast convolution or by the convolution integral of equations (8). Significantly, it is the use by the invention of a free carrier SLM with electrodes that permits the efficient implementation and operation of the invention's optical computers and filters.

In view of the foregoing, the speed of operation, throughput, capacity, simplicity of construction and operation, and minimal power consumption and cost of an optical computer will become apparent. As a result, an optical computer in accordance with the present invention may be produced which is fast, simple, efficient, precise and economically suited for mass production and use in a wide variety of applications, for example in texture analysis, area, image and text correlation, radar signal processing, satellite picture correlation, and many others. Accordingly, the present invention may result in the significant increase in the speed of operation and decrease in the weight, size, power and costs of radar systems, communications and pattern recognition systems.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIGS. 1A, 1B and 1C illustrate embodiments of the invention based on fast convolution;

FIGS. 3A through 3I illustrate schematic diagrams of embodiments of elements for performing logical computations and their optical implementations which may be utilized in the systems of FIGS. 1A, 1B, 1C, 2A, 2B and 2C.

DESCRIPTION OF THE PREFERRED EMBODIMENTS

Figure 2A:
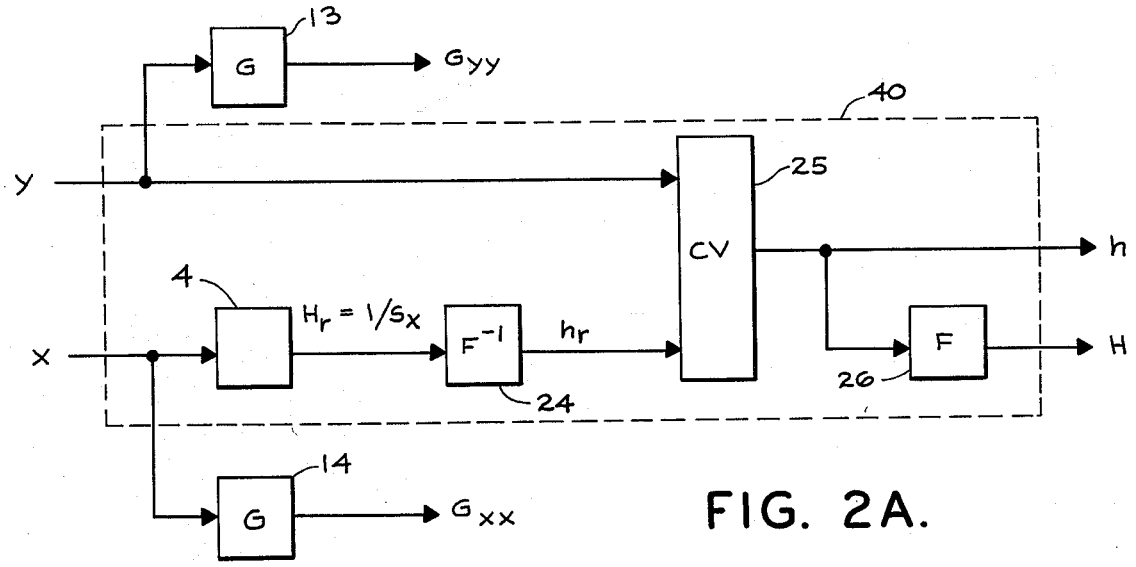
FIGS. 2A, 2B and 2C illustrate embodiments of the invention based on the convolution integral.

It is a well known matter in the prior art to use a hologram filter in the Fourier plane of a lens to obtain a convolution function. However, there is a time delay in making and using the filter. An example of such a filter is shown in the article by G. Stroke "Optical Computing" appearing in the December, 1972 issue of IEEE Spectrum.

To obtain addressable filters, a number of devices are also known in the prior art, for example elastomerics, the Pockels Readout Optical modulator, hybrid field liquid crystals, and electronically addressed input devices, which can be used in the Fourier transform plane of an optical processing system and act as addressable filters. The advantage of using such devices is that the filter can be generated by writing the required function into the device either optically or electronically. The filter once used can be erased and a new filter can be written in. Complex filters using such devices can be generated as holographic filters, except that the hologram is temporarily recorded on the particular device rather than on film. This can all be seen in the articles by B. Thompson and D. Cassasent both appearing in the 1977 Proceedings IEEE Special Issue on Optical Computing. Significantly, while the prior art is highly suggestive of an addressable filter it has nevertheless failed to produce a simple inexpensive apparatus. This can only be attributed to the fact that the recording of images onto spatial light modulators (SLMs) while advanced beyond the film stage nevertheless still suffers many of the time delay and handling problems that occur if the film itself were being used. The present SLMs therefore still prevent the practical implementation of addressable filters, i.e., having real-time optical processors.

It is the purpose of the system of the invention to provide an addressable two dimensional optical filter which records images by holographically creating charges in potential wells established by applying voltages to electrodes in a free carrier source material and then illuminating the hologram to reproduce images. This is done preferably by using different wavelengths for recording (writing) and reproducing (reading) images, for example using a charge coupled device (CCD).

FIGS. 1A, 1B and 1C are schematic diagrams of the system of the present invention based on fast convolution. FIGS. 1A and 1B measure the transfer function of two signals y and x appearing at their inputs. The measured transfer function H may be used to compute the impulse response h and coherence function $\gamma$ as desired. FIG. 1C measures the coherence function $\gamma$ of two signals y and x appearing at its input. The measured coherence function $\gamma$ may be used to compute the impulse coherence $\Gamma$ and transfer function H as desired.

In FIG. 1A signals y and x are inputted to first and second Fourier analyzers 1 and 2 in clutter filter 10 and these compute the frequency spectra $S_y$ and $S_x$ respectively in accordance with equations (1). Frequency spectrum $S_x$ is inputted to an inverter 3 which computes the transfer function $H_r = 1/S_x$ in accordance with equations (12). Fourier analyzer 2 is a second means in clutter filter 10 for coupling beam signals x as inputs to inverter I 3. Frequency spectrum $S_y$ is inputted to a multiplier 5 which also receives as input the transfer function $H_r$ from inverter 3 and provides at its output the transfer function H in accordance with equations (12). Transfer function H may be inputted to an inverse Fourier analyzer 6 to obtain the impulse response h in accordance with equations (12). Fourier analyzer 1 is a first means in clutter filter 10 for coupling beam signal y as input to multiplier 5. Power spectra $G_{yy}$ and $G_{xx}$ may be obtained by applying signals y and x to correlators 8 and 9 which compute auto correlations $R_{yy}$ and $R_{xx}$ in accordance with equations (3). Auto correlations $R_{yy}$ and $R_{xx}$ are inputted to Fourier analyzers 11 and 12 which compute auto power spectra $G_{yy}$ and $G_{xx}$ in accordance with equations (3). Correlator 8 and Fourier analyzer 11 form third means 13 for computing auto power spectrum $G_{yy}$. Correlator 9 and Fourier analyzer 12 form fourth means 14 for computing power spectrum $G_{xx}$. A simpler implementation of means 13 and 14 for computing auto power spectra $G_{yy}$ and $G_{xx}$ is the lens-detector means of the Wiener filter discussed previously.

In FIG. 1B signals y and x are inputted to correlator 15 in clutter filter 20 which then computes the cross correlation Rhd yx in accordance with equations (3). Cross correlation $R_{yx}$ is inputted to Fourier analyzer 16 which provides as output the cross power spectrum $G_{yx}$ in accordance with equations (3). Correlator 15 and Fourier analyzer 16 form means 17 for computing cross power spectrum $G_{yx}$. Signal x is inputted to means 14 for computing auto power spectrum $G_{xx}$. Auto power spectrum $G_{xx}$ is inputted to an inverter 3 which computes the transfer function $H_r' = 1/G_{xx}$ in accordance with equations (12). Power spectrum analyzer 14 is a second means in clutter filter 20 for coupling signal x as input to inverter I3. Cross power spectrum $G_{yx}$ is inputted to a multiplier 5 which also receives as input the transfer function $H_r'$ from inverter 3 and provides at its output the transfer function H in accordance with equations (12). The transfer function H may be inputted to an inverse Fourier analyzer 6 to obtain the impulse response h in accordance with equations (12). Power spectrum analyzer $G_{yx}$ 17 is a first means in clutter filter 20 for coupling signals y and x as input to multiplier 5. Means 13 may be used for computing the auto power spectrum $G_{yy}$.

In FIG. 1C signals y and x are inputted to means 13 and 14 in clutter filter 30 and these compute auto power spectra $G_{yy}$ and $G_{xx}$ in accordance with equations (3). Auto power spectra $G_{yy}$ and $G_{xx}$ are inputted to inverters 21 and 3 which compute the inversions $1/G_{yy}$ and $1/G_{xx}$. Inversions $1/G_{yy}$ and $1/G_{xx}$ are inputted to a multiplier 22 which computes the transfer function $H_r''=1/G_{yy}G_{xx}=(H_r')^2$ in accordance with equations (13). Power spectrum analyzers 13, 14 are a first means in clutter filter 20 for coupling signals y and x as inputs to inverters 21,3. Signals y and x are also inputted through a first means, comprising a power spectrum analyzer 17 and squarer 5*a*, in clutter filter 30 to a multiplier 5 which also receives the transfer function $H_r''$ from multiplier 22 and provides at its output the coherence function $\gamma$ in accordance with equation (5). The coherence function $\gamma$ may be inputted to an inverse Fourier analyzer 6 to obtain the impulse coherence $\Gamma$.

In general, the method of FIG. 1 comprises the steps of optically computing the fast convolution, i.e., using the second of equations (8). More specifically, the method of FIG. 1 comprises the steps of: inputting signals y and x into an optical computer; computing the frequency spectrum $S_y$; computing the transfer function $H_r$ of a clutter filter using signal x; forming the product spectrum $H=S_yH_r$; and, inverse transforming the product spectrum $S_yH_r$ to obtain the impulse response h. Alternatively, the method of FIG. 1 can comprise the steps of: inputting signals y and x into an optical computer; computing the power spectrum $G_{yx}$; computing the power spectrum transfer function $H_r'$ of the clutter filter using signal x; forming the product spectrum $H=G_{yx}H_r'$; and, inverse transforming the product spectrum $G_{yx}H_r'$ to obtain the impulse response h. As a second alternative, the method of FIG. 1 can comprise the steps of: inputting signals y and x into an optical computer; computing the power spectrum $G_{yx}^2$; computing the power spectrum transfer function $H_r''$ of a clutter filter using signals y and x; forming the product spectrum $\gamma=G_{yx}H_r''$; and, inverse transforming the product spectrum $G_{yx}H_r''$ to obtain the impulse coherence $\Gamma$.

Figure 2B:
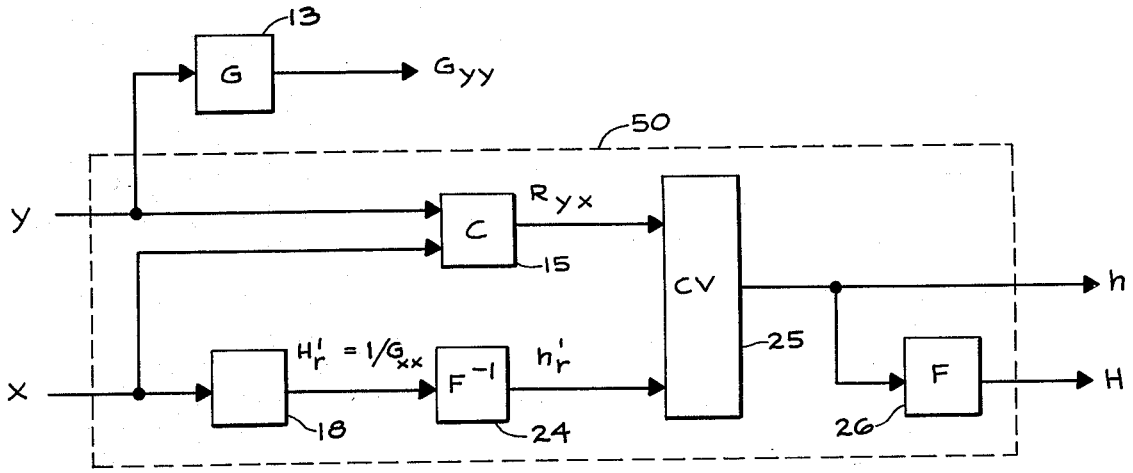
Figure 2C:
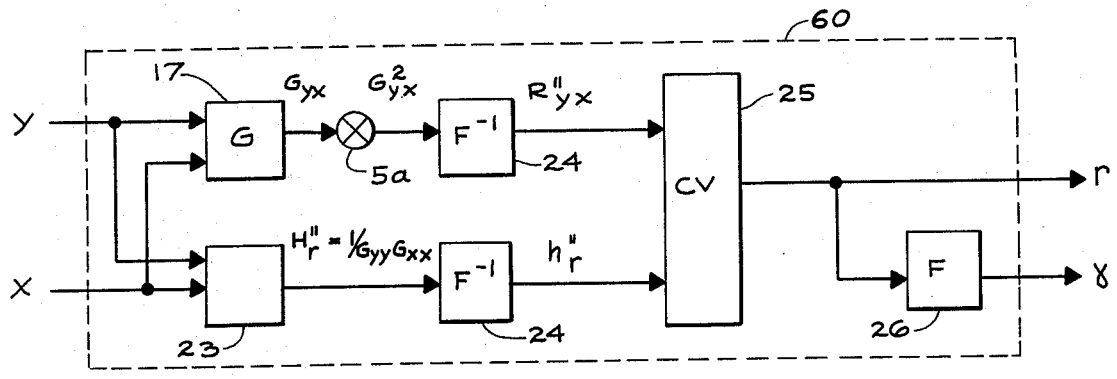

FIGS. 2A, 2B, and 2C are schematic diagrams of systems of the present invention based on the convolution integral. FIGS. 2A and 2B measure the impulse response h of two signals y and x appearing at their inputs. The impulse response h may be used to compute the transfer function H and coherence function $\gamma$ as desired. FIG. 2C measures the impulse coherence $\Gamma$ of two signals y and x appearing at its input. The measured impulse coherence $\Gamma$ may be used to compute the coherence function $\gamma$ and transfer function H as desired.

In FIG. 2A signal x is inputted to means 4 in clutter filter 40 and this computes the transfer function $H_r=1/S_x$ in accordance with equations (12). Transfer function $H_r$ is inputted to an inverse Fourier analyzer 24 which computes the impulse response $h_r$ in accordance with equations (9). Signal y is inputted to a convolver 25 which also receives as input the impulse response $h_r$ from inverse Fourier analyzer 24 and provides at its output the impulse response h in accordance with the first of equations (8). The impulse response h may be inputted to a Fourier analyzer 26 to obtain the transfer function $H=F\{h\}$. Means 4 and inverse Fourier analyzer 24 are a second means in clutter filter 40 for coupling signal x to convolver 25. Third and fourth means 13 and 14 may be used for computing auto power spectra $G_{yy}$ and $G_{xx}$.

In FIG. 2B signal x is inputted to means 18 in clutter filter 50 and this computes the transfer function $H_r'=1/G_{xx}$ in accordance with equations (12). Transfer function $H_r'$ is inputted to an inverse Fourier analyzer 24 which computes the impulse response $h_r'$ in accordance with equations (9). Signals y and x are inputted to a correlator 15 which computes the cross correlation $R_{yx}$ in accordance with equations (3). Cross correlation $R_{yx}$ is inputted to a convolver 25 which also receives as input the impulse response $h_r'$ from inverse Fourier analyzer 24 and provides at its output the impulse response h in accordance with the first of equations (8). The impulse response h may be inputted to a Fourier analyzer 26 to obtain the transfer function $H=F\{h\}$. Correlator 15 is a first means in clutter filter 50 for coupling signals y and x to convolver 25. Means 18 and inverse Fourier analyzer 24 are second means in clutter filter 50 for coupling signal x to convolver 25. Third means 13 may be used to obtain the auto power spectrum $G_{yy}$.

In FIG. 2C signals y and x are inputted to means 23 in clutter filter 60 and this computes the transfer function $H_r''=1/G_{yy}G_{xx}=(H_r')^2$ in accordance with equations (13). Transfer function $H_r''$ is inputted to an inverse Fourier analyzer 24 which computes the impulse response $h_r''$ in accordance with equations (13). Means 23 and inverse Fourier analyzer 24 are second means in clutter filter 60 for coupling signals y and x to convolver 25. Signals y and x are inputted through a first means in clutter filter 60 to a convolver 25 which also receives as input the inpulse response $h_r''$ from Fourier analyzer 24, and computes the impulse coherence $\Gamma$ in accordance with equations (13). The first means in clutter filter 60 couples signals y and x to means 17 for computing the cross power spectrum $G_{yx}$. Cross power spectrum $G_{yx}$ is inputted to a multiplier (squarer) 5*a* to obtain $G_{yx}^2$. The square power spectrum $G_{yx}^2$ is inputted to an inverse Fourier analyzer 24 to obtain the cross correlation $R_{yx}''=F^{-1}\{G_{yx}^2\}$. Thus, the first means in clutter filter 60 is for coupling signals y and x to convolver 25. The impulse coherence $\Gamma$ may be inputted to a Fourier analyzer 26 to obtain the coherence function $\gamma=F\{\Gamma\}$.

In general, the method of FIG. 2 comprises the steps of optically computing the convolution integral, using the first of equations (8). More specifically, the method of FIG. 2 comprises the steps of: inputting signals y and x into an optical computer; computing the impulse response $h_r$ of a clutter filter using the signal x; forming the convolution $h=y*h_r$ between the signal y and impulse response $h_r$; and, transforming the convolution $y*h_r$ to obtain the transfer function H. Alternatively, the method of FIG. 2 can comprise the steps of: inputting signals y and x into a clutter filter; computing the cross correlation $R_{yx}$; computing the impulse response $h_r'$ of a clutter filter using the signal x; and, computing the convolution $h=R_{yx}*h_r'$ between the cross correlation $R_{yx}$ and impulse response $h_r'$; and, transforming the convolution $R_{yx}*h_r'$ to obtain the transfer function H. As a second alternative, the method of FIG. 2 can comprise the steps of: inputting signals y and x into an optical computer; computing the cross correlation $R_{yx}''$; computing the impulse response $h_r''$ of a clutter filter using the signals y and x; computing the convolution $R_{yx}''*h_r''$ representing the impulse coherence Γ; and, transforming the impulse coherence Γ to obtain the coherence function γ.

FIGS. 3A through 3I are schematic diagrams of embodiments of elements for performing logical computations and their optical implementations which may be utilized in the systems of FIGS. 1A, 1B, 1C, 2A, 2B and 2C. Shown in each figure is a block with the letter of symbol which identifies the logical element as it appears in any one or more of FIGS. 1A, 1B, 1C, 2A, 2B and 2C and its corresponding optical implementation.

In FIG. 3A signal y is inputted to a Fourier analyzer F and this computes the frequency spectrum $S_y$ in accordance with equations (1). A monochromatic carrier laser source 100 provides coherent electromagnetic energy to a collimating lens 101 which illuminates an electro-optic (E/O) converter 102 located in the front plane $P_1$ of a lens 103. Signal y inputted to converter 102 will produce the frequency spectrum $S_y$ in the blackplane $P_2$ of lens 103. In the figure, f is the focal distance of lens 103. The frequency spectrum $S_y$ may be detected in an output detector, for example a detector array or TV tube (not shown). Input converter 102 may be any one of a number of types including such input devices as electromagnetic delay lines membrane light modultors as described in the reference by K. Preston or electro-acoustic, acoustic-optic, the Lumatron, von Ardenne tube, electron beam scan laser, the Titus tube as described in the article by G. Stroke and in the papers by D. Casasent, H. Weiss, W. Kock, P. Greguss and W. Weidelich, and G. Winzer in the 1975 IEEE Special Issue on Computers, and the input devices described in the articles by B. Thompson and D. Casasent. Formation of such a Fourier analyzer is well known in the prior art and will be obvious to those skilled in the art. It will be appreciated that the laser 100, lens 101 and converter 102 are needed only when signal y is other than optical and therefore these units are not needed when signal y is in optical form. FIG. 3A illustrates the well known Fourier relationship which exists between the front and back planes of a lens 103.

In FIG. 3B signals, say $S_y$ and $H_r$, are inputted to a modulator which performs the function of a multiplier ⊗ and this computes the product $S_yH_r$ of the two dimensional frequency spectra $S_y$ and $H_r$. Spectra $S_y$, $H_r$, and a constant beam A (not shown) are inputted, generally from different angles, to a positive non-linear element 107 in the form of a semiconductor free carrier source whose output is the product spectrum $S_yH_r$. Alternatively, spectra $S_y$ and $H_r$ may be inputted to non-linear element 107 through a combiner 104 which combines and directs beams 105 and 106 to semiconductor 107. Thus, beams 105 and 106 fall on semiconductor 107 from different aspects or from the same aspect through combiner 104 as desired. The role of combiner 104 will be more fully explained later in a second holographic implementation of the system of FIG. 3B. The transmission characteristics of the semiconductor free carrier source 107 are varied by the creating of free carriers in it. The free carriers are created by the modulating light beam 106 whose wavelength differs from that of the carrier beam 105. The free carrier source 107 is transparent to the carrier light beam 105 when the source 100 of light beam 106 is not generating a light beam 106 but varies the opacity and phase to the carrier light beam 105 when the modulating light beam 106 source 100 is generating a light beam 106. The relative opaqueness and/or phase change due to said free carrier source 107 is related to the average incident power density of the light beam 106 generated by the modulating light beam's source 100. It will be appreciated by those in the art that the index of refraction of the semiconductor 107*a* and 107*b* material is a function of the presence of free carrier electrons in the conduction band of said material and varies as a function of the intensity of modulating light beam 106. For example, the carrier beam 105 source 100 may be a $CO_2$ laser that generates a signal of 10.6 mirons while the modulating beam 106 source 100 may be a gallium arsenide injection laser that generates a signal of 0.9 micron. The light beam combiner 104 may be formed of germanium and the semiconductor free carrier source 107 may be formed of gallium arsenide doped with iron, for example. For the 10.6—0.9 micron lasers, the light beam combiner 104 must be formed so as to pass a beam 105 of 10.6 microns and reflect a beam 106 of 0.9 microns. Formation of such a light combiner will be obvious to those skilled in the art; hence it will not be discussed here. As stated above, the free carrier source 107 can be formed of gallium arsenide doped with iron. If this material is doped so as to have a resistivity of $10^6$ ohm-cm in is quiescent state, it is transparent to light in the 1.5 to 12.5 micron range. Because this range includes 10.6 mirons, the light beam 105 generated by a 10.6 micron source 100 passes through the free carrier source 107 unmodulated; that is, the free carrier source 107 is transparent to a 10.6 micron light beam 105. In addition, gallium arsenide doped with iron having a resitivity of $10^6$ ohm-cm is not transparent to the modulating light beam 106 because that beam is 0.9 micron. However, the 0.9 micron radiation of modulating light beam 106 creates free carriers in source 107. These free carriers vary the transparency of the free carrier source 107 to the 10.6 micron radiation of carrier beam 105. Now, if the intensity of the incident 0.9 micron radiation of modulating light beam 106 is varied in time or varies spatially as it falls on free carrier source 107, the number of free carriers generated in the free carrier source is varied. This variation modulates the transparency of the free carrier source 107 to, in turn, modulate the 10.6 micron radiation of carrier beam 105 in either amplitude and/or phase depending on the amplitude of beam 106 and the parameters of free carrier source 107. The material parameters of free carrier source 107 being: effective mass; diffusion coefficient; recombination relaxation time; doped carrier density; and mobility. The parameters therefore of free carrier source 107 may be selected to vary the transmission of carrier beam 105.

Consider now the use of a charge coupled device (CCD) as a spatial light modulator SLM. It is a well known fact that a CCD can record optical signals and reproduce them electrically. Thus, a CCD can be used as an opto-electric SLM output device within the context of this invention. However, in the system of the invention a CCD is specified which both records and reproduces images optically. Thus, while CCD's have been used in the past to detect images by recording intensity variations in a free carrier source, the invention extends the use of a CCD to record amplitude and phase variations in a free carrier source, i.e., the use of a CCD to holographically record and reproduce images. It will be appreciated by those in the art that the replacing of film by a CCD device of the invention implements real time addressable filters while the replacing of the prior art SLMs by a CCD device of the invention implements efficient real time optical processing.

Referring to FIG. 3B, signal $H_r$ 106 is used to holographically record its information in semiconductor 107 which, when specified as a CCD, is essentially in two parts: a silicon dioxide $SiO_2$ insulator 107*a* and a silicon Si substrate 107*b*. When illuminated by signal $H_r$ 106 at a wavelength responsive to semiconductor 107, the interference of signal $H_r$ 106 and an appropriate bias or reference signal $A_2$ (not shown) creates a hologram record in semiconductor 107 in the form of charge variations at the $SiO_2$—Si layer and in the Si substrate 107*b*. Significantly, the charge variation preserves the amplitude and phase of signal $H_r$ 106 in the manner of a conventional hologram. Unlike the conventional CCD, the transparent electrodes 108 are not for transferring charges to an electrical output but, as specified by the invention, are for holding and erasing charges and images. This is done by using a voltage 109 to form stationary potential wells in Si substrate 107*b* during the optical integration (recording) period of signal $H_r$ 106 and then for quickly erasing the hologram once the information has been read. The reading is done by illuminating semiconductor 107 with read beam $S_y$. Since the record (transmittance) in semiconductor 107 is proportional to $H_r$ and $H_r$* amongst other things, the particular output $S_yH_r$ can be spatially detected and provided at the output of semiconductor 107. The conventional use of a CCD has been discussed in a number of publications including the articles by G. Amelio "Charge Coupled Devices" Scientific American May, 1974, 1974 WESCON "Introduction to Charge Coupled Devices" Session 2 papers presented at WESCON Los Angeles, Sept. 10–13, 1974, B. Deliduka "Enormous Bucket Brigade Optical Scanner Achieves High Efficiency" Computer Design February, 1976, W. Kosonocky and D. Sauer "Consider CCDs for a Wide Range of Uses" Electronic Design Mar. 15, 1976, D. Barbe "Advanced Infrared Focal Plane Array Concepts" Electro-Optics Systems Design April, 1977, and D. Buss et al "CCDs: Versatility With Integration" Microwave Systems News October, 1977. Thus, the implementation of the multiplier of FIG. 3B using the invention CCD will be obvious to those skilled in the art. More generally, the specification of a SLM using the invention CCD is a unique feature of the invention.

It should be understood as being without the context of the invention that while semiconductor 107 is shown as a simple CCD in two parts, insulator 107*a* and substrate 107*b*, any one of a number of electrode 108, insulator 107*a* and substrate 107*b* geometrical configurations are possible. Thus, electrode 108, insulators 107*a* and substrates 107*b* may be sandwiched and arrayed together to enable the forming of surface and volume holograms as desired, the criterion being the establishment of the potential wells at the appropriate locations in the material of semiconductor 107 by applying appropriate voltages 109. For example, a single combination of a planar electrode, insulator 107*a* and substrate 107*b* might be used to form a surface hologram, amplitude transmittance or grating, while a plurality of similar units may be sandwiched together and might be used to form a volume hologram. Electrodes 108 themselves are transparent to light, for example these may be doped polysilicon gates, and essentially serve the purpose of grids in the path of two dimensional beams 105 and 106. And, while the material parameters of semiconductor 107 may be selected to provide the carriers (positive or negative charges) and the voltages 109 may be selected to establish the potential wells at the desired locations in semiconductor 107, these more generally control the index of refraction and linearity characteristics, i.e., a material constant ($\beta$), of semiconductor 107 in order to bring about the recording response of material 107 to the recording illumination of beam 106. Thus, it is possible to construct a CCD 107 which records one of the amplitude, phase, amplitude and phase, and intensity of beam 106.

The change in transmission $\Delta T$ of the medium of semiconductor 107 will be proportional to $|H_r+A_2|^2$ which represents the intensity of the sum of beams $H_r$ and $A_2$ falling on semiconductor 107, for example, in the manner of recording a hologram. Thus, if $A_2$ is a constant beam, for example the reference beam used when making the hologram, then $\Delta T$ is the record of $H_r$. If carrier beam $S_y$ 105 is present, the light amplitude which is transmitted through semiconductor 107 will be the product of the incident amplitude of carrier beam $S_y$ 105 times the transmittance $\Delta T$. Therefore, the wavefront appearing at the output of semiconductor will be, except for a constant, $S_yH_r$ representing the product of the carrier $S_y$ 105 and modulating $H_r$ 106 beams.

Semiconductor 107 replaces the film in a hologram, i.e., when forming a hologram on semiconductor 107 rather than on film. Beams 105 and 106 are directed to semiconductor 107 from different angles using the Leith-Upatnieks method of holography. One example of the use of the Leith-Upatnieks method to form holograms of the type specified also by the invention is shown in U.S. Pat. No. 3,542,452.

In general, free carrier source 107 is a non-linear transmission medium. One example of a non-linear transmission medium with short persistence is a mica sheet filled with cryptocyanine which has been inserted between the mica flakes of the mica sheet. Other examples of transmission mediums having non-linear transmission characteristics and short persistence are saturable absorbers such as selenium films, materials with strong electro-optical effects such as nitrobenzene, crystals like KDP, ADP, $LiNbO_3$, and materials with large shifts in bandgap in strong light fields such as GaAs and SbSI. Another example of a non-linear transmission medium within the context of this disclosure is a material whose index of refraction or absorption changes in a nondestructive, quickly self-recoverable way from localized heating resulting from the incident radiation. The term non-linear is used to describe a material whose transmittance $\Delta T$ is proportional to $|A|^\beta$ where $|A|$ is the amplitude of the input light which illuminates the material and $\beta$ is a known constant of the material. For positive transparencies $\beta$ is a positive number, while for negative transparencies $\beta$ is negative. Thus, illumination by S produces $S|A|^\beta$ at the output of the non-linear material.

The intensity of the light impinging on each part of free carrier source 107 depends on the respective amplitude and phase of waves $H_r$ and $A_2$ arriving at that point from modulating beam 106. Thus, the intensity of the light will vary from point to point to produce changes in the index of refraction or absorption of free carrier source 107. Since free carrier source 107 is non-linear, the change of its index of refraction or absorption will cause changes in the transmission $\Delta T$ of carrier beam 105. In the system of FIG. 3B, modulation beam 106 is applied to free carrier source 107 and causes the stated changes in the transmission so that the application of carrier beam $S_y$ 105 will be modulated by modulating beam $H_r$ 106 (more precisely by the record of $H_r$ in semiconductor 107) to produce the product beam $S_yH_r$ at the output of semiconductor 107.

Up to this point non-linear element 107 has been disclosed primarily in terms of replacing the film in conventional holography. This is the holographic implementation of the system of the invention in which a single element 107 is used to record both the amplitude and phase of spectrum $H_r$ and thereby to modulate the passage of spectrum $S_y$ and to obtain the product $S_y$ and to obtain the product $S_yH_r$. In a second holographic implementation, let spectra $S_y$ and $H_r$ be inputted to a beam combiner 104*a* which combines and directs beams 105*a* and 106*a* to a semiconductor 107*a*. If the transmittance of semiconductor 107*a* is $|H_r|$, i.e., responding to $H_r$ 106*a*, then the signal $S_y|H_r|$ appears at the output of semiconductor 107*a*. Next, let spectra $H_r$ at different wavelengths be inputted to a beam combiner 104*c* which combines and directs beams 105*c* and 106*c* to a semiconductor 107*c*. If the transmittance of semiconductor 107*c* is $1/|H_r|$, i.e., responding to $H_r$ 106*c*, then the signal $H_r/|H_r|$ appears at the output of semiconductor 107*c*. Finally, let spectra $S_y|H_r|$ and $H_r/|H_r|$ be inputted to a beam combiner 104*b* which combines and directs beams 105*b* and 106*b* to a semiconductor 107*b*. If the transmittance of semiconductor 107*b* is $H_r/|H_r|$, i.e., responding to the spectrum $H_r/|H_r|$, then the signal $S_yH_r$ appears at the output of semiconductor 107*b* and this is the desired product of signals $S_y$ and $H_r$. The material parameters therefore of free carrier sources 107*a*, 107*b* and 107*c* may be selected to vary the transmission of carrier beams 105*a* and 105*b* to produce the product $S_yH_r$ of signals $S_y$ and $H_r$ at the output of semiconductor 107*b*. The system just described, i.e., comprising semiconductors 107*a*, 107*b* and 107*c*, is an alternative holographic system to the system previously described for using a single semiconductor 107 as a transitory hologram. Either system can be used by the invention. Importantly, elements 107*a*, 107*b* and 107*c* can be implemented as CCDs.

A first comparison of the holographic systems of the invention, i.e., the use of a single semiconductor 107 replacing the conventional film in holography and the use of amplitude transmittance semiconductor 107*a* ($\beta=1$), 107*c* ($\beta-=1$) and phase transmittance semiconductor 107*b*, suggests the former being the simplest apparatus and method. However, the alternative holographic system is useful in a parallel processor where it is desired to process two-dimensional signals in parallel or in-line spatial beams and wherein the implementation of the alternative holographic system elements 107*a*, 107*b* and 107*c* are relatively easy to make, compared to the making of a single holographic element 107 to obtain the desired performance. It should be understood in FIG. 3 that a reference beam A (not shown) is used to record elements 107.

In general, the method of FIG. 3B comprises the steps of optically computing the product $S_yH_r$ of two two-dimensional signals $S_y$ and $H_r$. This is accomplished by impinging a pair of two-dimensional light beams onto a two-sectioned semiconductor material 107*a* and 107*b* whose parameters have been selected to record in real time the amplitude and phase of a light beam $H_r$. One light beam $S_y$ is a carrier beam and the material is normally transparent to that beam. The second is a modulating light beam $H_r$ and creates free carriers in the material which varies the transmission characteristics of the material with respect to the carrier beam. This variation in transmission characteristics (amplitude and phase) modulates the carrier beam so that the output from the material is a modulated product beam. More specifically, the method preferred for implementing the multiplier of FIG. 3B comprises the steps of: generating a two-dimensional carrier beam; directing the carrier beam to a free carrier source that is normally transparent to said carrier light beam; generating a two-dimensional modulating light beam; and directing said modulating light beam to said free carrier source so as to vary the transmission of said free carrier source and thereby to vary the amplitude and phase of said carrier light beam. The method of the invention can include the additional step of combining the carrier and modulating light beams and directing the two beams along a common axis to said free carrier source. The method of implementing the multiplier of FIG. 3B can be modified by applying electric potentials to surfaces of the free carrier source, or by applying a magnetic field along the direction of propagation of the modulating light signal so that constrictions on the free carrier spatial distribution can be affected. The application of the magnetic field along the direction of propagation of the modulating light signal restricts the free carrier diffusion to a path parallel to the direction of propagation of the modulated light, thereby causing the spatial distribution of the carrier beam to be further controlled. The electric or magnetic field generating elements are illustrated by electrodes 108 connected to a signal generator 109. A one-dimensional modulator which utilizes a free carrier source to modulate a thin carrier beam has been disclosed in U.S. Pat. No. 3,555,455. Thus the present invention discloses method and apparatus for the modulation of a two-dimensional carrier beam thereby extending the number of applications for modulators of this type, defined primarily as optical-optical, i.e., one optical beam modulating a second optical beam. Formation therefore of the multiplier of FIG. 3B will be obvious to those skilled in the art. It will be appreciated that a variety of apparatus is also suitable for carrying out the method in any portion of the electromagnetic spectrum, for example for optically modulating an infrared (IR) or microwave carrier beam. Thus other laser sources than those generating 10.6 and 0.9 microns can be used. And other combiners and free carrier sources operating at other wavelengths, for example visible light, IR, and microwave, can be used to carry out the invention. It will also be appreciated that a variety of apparatus using a free carrier source can be used for implementing the multiplication of FIG. 3B, the only requirement being the specification of the invention for storing or accumulating charges in well defined potential wells (electric or magnetic) formed by applying voltages 109 via electrodes 108 to the free carrier source 107. The modulator with electric potential wells just disclosed in FIG. 3B, however, is a preferred one. Hence the implementation of the multiplier of FIG. 3B can be practiced otherwise than as specifically described herein. It will be appreciated by those skilled in the art that the multiplier of FIG. 3B enables the multiplication of signals in real time and thereby eliminates the fixed transparencies and near real time operation practiced by the prior art.

Figures 3G, 3H, 3I:
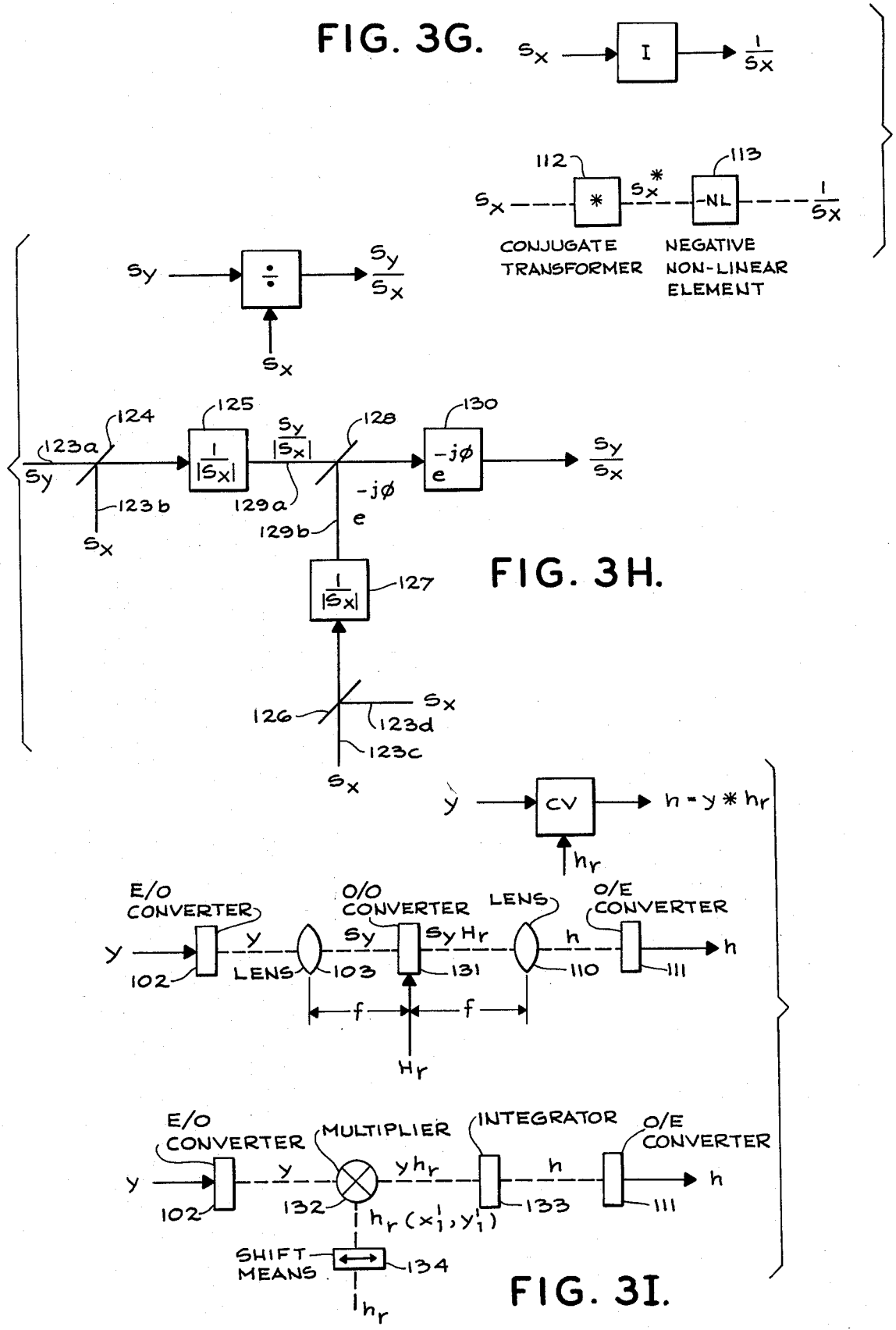

In FIG. 3C signal $S_yH_r$ is inputted to an inverse Fourier analyzer $F^{-1}$ and this computes the inpulse response $h=y*h_r$ as the convolution of signals y and $h_r$ in accordance with equation (4). This is by virtue of the fact that when a spectral distribution is placed in the front plane $P_2$ of lens 110 its inverse Fourier transform will appear in the backplane $P_3$ of lens 110. By way of example, lens 110 may be placed so that its frontplane $P_2$ coincides with the backplane of lens 103 of FIG. 3A in which the multiplier of FIG. 3B has also been placed thus providing as an output the product $S_yH_r$ which can then be inputted to lens 110. An opto-electrical (O/E) output device 111 may be placed in the blackplane $P_3$ of lens 110 for interfacing the optical output of lens 110 with the electrical, acoustical, IR, microwave, or visible signals of the outside world. Output device 111 may be any one of a number of known devices, for example arrays of light detectors, image sensors, scan camera TV tubes as described in the book by K. Preston. Thus, formation of the inverse Fourier analyzer of FIG. 3C will be obvious to those skilled in the art. It will be appreciated by those skilled in the art that the system of FIG. 3C when taken in combination with the systems of FIGS. 3A and 3B performs the computation of the convolution of signals y and $h_r$, i.e., acts as a convolver. And, for a suitable selection of signals, for example when $H_r=S_x^*$ or $S_y^*$, the convolver becomes a correlator. An alternative embodiment of a convolver will be disclosed in connection with the system of FIG. 3I.

In FIG. 3D (top) signal $S_x$ is inputted to a conjugate transformer * whose output is the frequency spectrum $S_x^*$ representing the complex conjugate of frequency spectrum $S_x$ of signal x. There are two implementations of the conjugate transformer, as a holographic and parallel processor. In the holographic processor, the application of signal $S_x$ and a bias or reference signal A (constant amplitude and phase not shown) to a single positive non-linear element records the intensity $|S_x+A|^2$ which contains the terms $(|S_x|^2+A^2)$, $AS_x^*$, and $AS_x$. When illuminated by a constant signal, the terms at the output of the non-linear element can be spatially separated using the Leith-Upatnieks method of holography. The use of the Leith-Upatnieks method to separate the beams from a non-linear element is shown in U.S. Pat. No. 3,542,452. For practical purposes therefore, the output of the non-linear element may be selected, except for a constant, as $S_x^*$, i.e., the desired complex conjugate function. The use therefore of a positive non-linear element as a holographic processor to obtain a conjugate transformer will be obvious to those skilled in the art.

Next, consider the parallel processor implementation of a conjugate transformer, as shown in FIG. 3D (bottom). Signal $S_x$ 120 is inputted to a negative non-linear element 119 through one way mirror 117*a*. If the transmittance of semiconductor 119 is $1/|S_x|$, i.e., responding to $S_x$ 120, then the signal $|S_x|/S_x=e^{-j\phi}$ appears outputted to the right when a signal $S_x$ 120*a* illuminates semiconductor 119 from the left. If the illumination were to be reversed, i.e., coming from the left, then the signal $S_x/|S_x|=e^{j\phi}$ would appear on the left of semiconductor 119 but this signal does not have the desired phase to form conjugate signal $S_x^*=|S_x|e^{-j\phi}$. Hence the illumination by $S_x$ 120*a* is from the left as shown. Signals $e^{-j\phi}$ 122 and $S_x$ 121 are inputted to a one way mirror 117*b* which directs beams 121 and 122 to a positive non-linear element 118. If the transmittance of semiconductor 118 is $|S_x|$, i.e., responding to $S_x$ 121, then the signal $S_x^*=|S_x|e^{-j\phi}$ appears at the output of semiconductor 118. The material parameters of free carrier sources 118 and 119 may be selected to vary the transmission of carrier beams 120*a* and 122 to produce the conjugate signal $S_x^*$ at the output of semiconductor 118. The system of FIG. 3D (bottom) is therefore an alternative holographic system to the system previously described for using a single non-linear element as a transitory hologram FIG. 3D (top). Either system can be used by the invention. Importantly, elements 118 and 119 can be implemented as CCDs.

A first comparison of the holographic top and parallel bottom processors of the FIG. 3D system of the invention suggests the former being the simplest apparatus and method. However, as explained previously in connection with the holographic and parallel processors of the FIG. 3B system of the invention, it may be easier to obtain the desired operation with elements of the parallel processor.

In general, the method of FIG. 3D comprises the steps of optically computing the conjugate frequency spectrum $S_x^*$. More specifically, a first method of FIG. 3D comprises forming signal $S_x$ from input signal x and forming a reference signal A; inputting signals $S_x$ and A into a non-linear element; operating the non-linear element as a hologram; and illuminating the hologram to obtain the complex conjugate function $S_x^*$. A second method of FIG. 3D comprises of recording signal $1/|S_x|$ in a first hologram; recording signal $|S_x|$ in a second hologram; illuminating the first hologram to obtain the phase function $e^{-j\phi}$; and illuminating the second hologram with the phase function $e^{-j\phi}$ to obtain the conjugate function $S_x^*$. It will be appreciated that the method applies to obtaining the complex conjugate of a power spectrum equally well.

In FIG. 3E signals y and x are inputted to a power spectrum analyzer G and this computes the cross power spectrum $G_{yx}=S_yS_x^*$ in accordance with equations (2). Signals y and x are inputted to Fourier analyzers F and these compute the frequency spectra $S_y$ and $S_x$, respectively. Frequency spectrum $S_x$ is inputted to a conjugate transformer 114 whose output is the conjugate frequency spectrum $S_x^*$. Frequency spectra $S_y$ and $S_x^*$ are inputted to a multiplier whose output is the product $G_{yx}=S_yS_x^*$ representing the cross power spectrum $G_{yx}$ of signals y and x. Thus, formation of the cross power spectrum analyzer of FIG. 3E will be obvious to those skilled in the art.

In general, the method of FIG. 3E comprises the steps of optically computing the cross power spectrum $G_{yx}=S_yS_x^*$ of signals y and x. More specifically, a preferred method of FIG. 3E comprises the steps of: inputting signals y and x into an optical computer; computing the frequency spectra $S_y$ and $S_x$ of signals y and x; computing the conjugate frequency spectrum $S_x^*$ of signal $S_x$; and, forming the product $G_{yx}=S_yS_x^*$ representing the cross power spectrum of signals y and x.

In FIG. 3F signals y and x are inputted to a correlator C and this computes the cross correlation $R_{yx}=y\bigstar x$ in accordance with equations (2). Signals y and x are inputted to a power spectrum analyzer G whose output is the cross power spectrum $G_{yx}=S_yS_x^*$ which is then inverse transformed in inverse Fourier analyzer $F^{-1}$ to produce the cross correlation $R_{yx}$. Thus, formation of the correlator of FIG. 3F will be obvious to those skilled in the art. It will be appreciated that correlator C is the system obtained by optically coupling the systems of FIGS. 3A, 3B, 3C in sequence with $H_r=S_x^*$ or $S_y^*$ as desired. Also, a comparison of systems shows that the correlator of FIG. 3F is the convolver of FIG. 1A but without negative non-linear element 113, i.e., using only the conjugate transformer 112 (114 in FIG. 3F) part of inverter 3 in FIG. 1A.

In general, the method of FIG. 3F comprises the steps of optically computing the cross correlation $R_{yx}=y\star x$ of signals y and x. More specifically, the method of FIG. 3F comprises the steps of: inputting signals y and x into an optical computer; computing the power spectrum $G_{yx}=S_yS_x^*$ of signals y and x; and, inverse transforming the power spectrum $G_{yx}$ to obtain the cross correlation $R_{yx}$.

In FIG. 3G signal $S_x$ is inputted to an inverter I and this computes the inversion $1/S_x$. Signal $S_x$ is inputted to a conjugate transformer 112 whose output is the complex conjugate $S_x^*$ which is then inputted to a negative non-linear element 113 whose output represents the inversion $1/S_x$. Conjugate transformer 112 and negative non-linear element 113 constitute the inverter. Non-linear element 113 preferably is in the form of a photochromic transparency.

In general, the method of FIG. 3G comprises the steps of optically computing the inversion $1/S_x$ of a signal $S_x$. More specifically, the method of FIG. 3G comprises the steps of: inputting the signal $S_x$ into an optical computer; computing the conjugate $S_x^*$ of said signal $S_x$; and, computing the inversion $1/S_x$.

The principle of non-linear optical processing requires a non-linear optical material whose complex field amplitude transmittance is either directly or inversely proportional to the intensity distribution in the light upon it. In addition to photochromes mentioned previously, saturable dyes are good candidates for non-linear elements. Thin slabs of such materials can be made to behave either as positive or negative non-linear elements through the additional choice of material and activation wavelength. The feasibility of using non-linear elements has been discussed in the paper by N. Farhat appearing in the 1975 IEEE Special Issue on Optical Computing. Examples of photochrome and organic dyes which may be utilized in making non-linear elements may be found in the references in N. Farhat's paper and in U.S. Pat. No. 3,542,452. The making therefore of a non-linear element will be obvious to those skilled in the art. A non-linear element may be illuminated by a coherent and collimated light beam having a wavelength which corresponds to the wavelength of the photochromic or dye. If for a given wavelength the photochromic or dye is initially in a transparent (bleached) state, the activating radiation will cause it to darken thus reducing its transmittance. The transmittance will vary spatially in accordance to the density distribution of the incident wavefield. The complex field amplitude energy g at the output of the photochromic transparency will then be, for a given input f and except for a constant $$g(x_2,y_2)=f(x_2,y_2)/|f(x_2,y_2)|^2=1/f^*(x_2,y_2) \quad (16)$$

for a negative photochromic. Thus, inputting $S_x^*$ into negative non-linear element 113 of FIG. 3G produces the inversion $1/S_x$. If the photochromic is chosen totally in a darkened state, the wavelength of the activating radiation is chosen so that the photochromic is bleached. The transmittance of the photochromic will then be "positive" or directly proportional to the incident intensity. The complex field amplitude energy from the photochromic transparency will then be, for a given input f and except for a constant $$g(x_2,y_2)=f(x_2,y_2)|f(x_2,y_2)|^2 \quad (17)$$

for a positive photochromic. Thus, inputting signal $S_x$ into negative non-linear element 119 of FIG. 3D will produce the phase $e^{-j\phi}$. And, inputting the phase $e^{-j\phi}$ into positive non-linear element 118 of FIG. 3D will produce the conjugate spectrum $S_x^*$. By way of yet another example, semiconductors 107*a* and 107*b* in FIG. 3B are positive non-linear elements while semiconductor 107*c* is a negative non-linear element, and semiconductor 118 in FIG. 3D is a positive non-linear element while semiconductor 119 is a negative non-linear element, these elements being any one of a number of types including polychromes and saturable dyes as well as p and n doped semiconductors that may be used to implement the invention. The results therefore of equations (16) and (17) show that a non-linear element can be designed to output its input divided by its input intensity when implemented as a negative element and can be made to output its input multiplied by its input intensity when implemented as a positive element. The making therefore of non-linear elements for performing a wide variety of optical computations will be obvious to those skilled in the art, particularly the making of non-linear elements using CCDs.

Referring to the materials which can be used to implement the non-linear elements of the invention, these include WRITE-READ-ERASE memories known in the priot art. These memories include photochromic materials such as strontium titanate, thermoplastics, various amorphous semiconductors, and ferroelectrics such as lithium niobate. Another material is a transparent ceramic called PLZT. Conducting electrodes may be deposited so as to enclose or sandwich the PLZT ceramic, so that when a two dimensional light pattern falls on the device, depressions are formed on the ceramic, thus causing the image to be recorded. Voltages 109 can be applied to the electrodes 108 to remove the depressions, enabling the ceramic to serve as an erasable storage device, for example first recording signal $H_r$ in non-linear element 107 in FIG. 3D, obtaining the product $S_yH_r$, and then using voltage 109 to erase the record. Thus, while the non-linear elements of the invention have been disclosed primarily as free carrier sources (semiconductors) their actual materials should not be so restricted.

The amorphous chalcogenide, arsenic trisulfide has been found useful as a WRITE-READ-ERASE holographic material. This memory can be read out as the data is being recorded, i.e., without any chemical developments being required. The holograms are made (exposed) with a low powered argon (green) laser beam, while the images are simultaneously being projected (reconstructed) with an even lower powered helium-neon (red) laser. The operator (holographer) can watch the image develop, and turns off the green laser when the image is fully recorded.

While the foregoing WRITE-READ-ERASE memories are for real time recording and reproducing of images, their specified use by the invention apparatus and method is for the real time generating of functions of signals, for example the multiplication, complex conjugation, division, integration, and so forth, of signals.

The foregoing equations (16) and (17) of non-linear elements state that the change in transmittance $\Delta T$ is one of proportional to and inversely proportional to the intensity of light in the material response band. Thus, if two light beams $A_1$ and $A_2$ fall on a positive non-linear element with $\beta=2$, the transmittance is given by $$\Delta T_a=|A_1|^2+|A_2|^2+A_1A_2^*+A_1^*A_2 \quad (18)$$

in which the terms $|A_1|^2=A_1A_1^*$ and $|A_2|^2=A_2A_2^*$ are the intensities of the individual waves $A_1$ and $A_2$ and the remaining terms are cross product terms.

The light amplitude transmitted through a positive non-linear element will be the product of the incident amplitude $A_3$ times the transmittance $\Delta T_a$ $$A_o=A_3\Delta T_a=A_3(|A_1|^2+|A_2|^2)+A_3A_1A_2^*+A_3A_1^*A_2 \quad (19)$$

which is a restatement of equation (17). It should be understood that while the wavelengths of beams $A_1$ and $A_2$ are within the response band of the material, the wavelength of beam $A_3$ may or may not be in the responding band.

The three terms in equation (19) represent the well known triad of beam outputs from a halogram and can be spatially separated by directing beams $A_1$ and $A_2$ to fall on the positive non-linear element from different directions, i.e., using the Leith-Upatnieks method of holography to separate beams. Thus, it is possible to obtain distinct beams $A_3(|A_1|^2+|A_2|^2)$, $A_3A_1A_2^*$, and $A_3A_1^*A_2$ at the output of a positive non-linear element.

Similarly, the light amplitude $B_o$ which is transmitted through a negative non-linear element is found by replacing $\Delta T_a$ by $(\Delta T_b)^{-1}$ in equation (18)

$$B_o = B_3\,\Delta T_b = \frac{B_3}{|B_1|^2 + |B_2|^2 + B_1B_2^* + B_1^*B_2} \quad (20)$$

which is a restatement of equation (16) and in which beams $B_1$ and $B_2$ form the hologram which modulates beam $B_3$. The special case $B_2=0$ reduces equation (20) to $$B_o=B_3/|B_1|^2 \quad (21)$$

Equations (18)-(21) have been provided to show the various possible examples within the context of this disclosure of the use of non-linear elements, the non-linear elements 107*a*, 107*b* and 107*c* of FIG. 3B, 118 and 119 of FIG. 3D and 113 of FIG. 3G being special cases given only by way of example.

In general, a single positive non-linear element 107 may be used to obtain any one of the terms of equation (19), for example terms proportional to $A_3(|A_1|^2+|A_2|^2)$, $A_3A_1A_2^*$, and $A_3A_1^*A_2$, by operating element 107 as a hologram. Thus, from the second term in equation (19), if $A_3=S_y$, $A_1=H_r$, and $A_2$ is a constant then the output of single positive non-linear element 107 is, except for a constant, $A_o=S_yH_r$. Or, from the second term in equation (19), if $A_3$ and $A_1$ are constants and $A_2=S_x$ then the output of single positive non-linear element 107 is, except for a constant, $A_o=S_x^*$. From this it is seen that a single positive non-linear element 107 may be used as a multiplier or conjugate transformer by operating element 107 as a hologram. And, a single negative non-linear element 107 can be used to obtain the division of equation (21). Thus, if $B_3=B_1=S_x$ then the output of single negative non-linear element 107 is, except for a constant, $B_o=1/S_x^*$ which indicates that a single negative non-linear element 107 can be used to obtain the inverse conjugate of a signal $S_x$. The foregoing concludes that a single positive non-linear element with $\beta=2$ can be used to form a hologram for computing the product $S_yH_r$ or the complex conjugate $S_x^*$, i.e., the hologram method of the invention as alternative to the second systems of FIGS. 3B and 3D using combinations of positive and negative transparencies with $\beta=1$ (elements 107*a*, 107*c*, 118, 119) and positive phase holograms (element 107*b*). While in the foregoing the material constant $\beta$ has been specified as $\pm1$, $\pm2$ by way of example, it should be understood that $\beta$ may have any desired value determined by the material properties.

In general, it should be understood that the making of a non-linear element of the invention by creating potential wells in a free carrier source preferably includes the steps of recording first images into the element holographically, i.e., using a reference beam (not shown in FIGS. 1-3) to record the first image as a transmittance of the element, and then reproducing the output image representing the desired mathematical operation (division, product, convolution, conjugation, inversion, shifting, integration, etc.) by illuminating the element with a second image, with the recording and reproducing made as desired at the same or different wavelengths and at the same or different times, i.e., with or without frequency and time multiplexing of first and second images.

In FIG. 3H signals $S_y$ and $S_x$ are inputted to a divider ÷ and this computes the division $S_y/S_x$. First, it will be appreciated that the multiplier of FIG. 3B is for multiplying signals $S_y$ and $H_r$. However, when $H_r=1/S_x$ the product appearing at the output of semiconductor 107*b* is $S_y/S_x$, i.e., a division. Thus, if the inverter of FIG. 3G is used to invert signal $S_x$ to signal $1/S_x$ and if the latter signal is inputted to the multiplier of FIG. 3B the result is the division $S_y/S_x$. The combination therefore of the multiplier of FIG. 3B and the inverter of FIG. 3G is a divider. This is in fact the combination of inverter I 3 and multiplier 5 in FIG. 1A. Shown in FIG. 3H is an alternative divider to the one just described. Signals $S_y$ 123*a* and $S_x$ 123*b* are inputted to a beam combiner 124 which combines and directs beams 123*a* and 123*b* to a negative non-linear element 125 whose transmittance is $1/|S_x|$, i.e., responding to beam $S_x$ 123*b*. The output of non-linear element 125 is the signal $S_y/|S_x|$. Signals $S_x$ 123*c* and $S_x$ 123*d* are inputted to a beam combiner 126 which combines and directs beams 123*c* and 123*d* to a negative non-linear element 127 whose transmittance is $1/|S_x|$, i.e., responding to beam $S_x$ 123*d*. The output of non-linear element 127 is the signal $e^{-j\phi}$ representing the phase of signal $S_x$. Output signals $S_y/|S_x|$ and $e^{-j\phi}$ are inputted to a beam combiner 128 which combines and directs beams 129*a* and 129*b* to a positive non-linear element 130 whose transmittance is $e^{-j\phi}$, i.e., responding to beam 129*b*. The output of positive non-linear element 130 is the division $S_y/S_x$. The system just discussed is the system of G. Stroke but where the films of elements 125, 127 and 130 are replaced by SLMs including the invention CCDs.

In general, the method of FIG. 3H comprises the steps of optically computing the division $S_y/S_x$ of two signals $S_y$ and $S_x$ in real time. More specifically, a first method of FIG. 3H comprises the steps of forming signals $S_y$ and $S_x$ from input signals y and x, respectively, inverting signal $S_x$ to obtain signal $1/S_x$, and then multiplying signals $S_y$ and $1/S_x$ to obtain the division $S_y/S_x$. A second method of FIG. 3H comprises the steps of forming signals $S_y$ and $S_x$ from input signals y and x, respectively, forming signals $S_y/|S_x|$ and $e^{-j\phi}$, and then forming the division $S_y/S_x$.

In FIG. 3I signals y and $h_r$ are inputted to a convolver CV and this computes the convolution $h=y*h_r$ in accordance with the first of equations (8). The realization of a convolver can be made in one of two ways, both as shown in the figure. First, convolution may be accomplished by inputting electrical signal y to an E/O converter 102 which converts electrical signal y to optical signal y. A lens 103 is utilized to convert optical signal y to its Fourier transform $S_y$ appearing at the back plane of lens 103 where it is multiplied by signal $H_r$ in O/O converter 131 for example a SLM. lens 110 is utilized to convert the product $S_yH_r$ to its Fourier transform h. O/O converter 131 is placed in the front plane of lens 110. An O/E converter 111 may be utilized to convert optical signal h to electrical signal h. It will be appreciated that E/O and O/E converters 102 and 111 are not needed when the original form of signal y and the desired form of signal h are optical.

E/O and O/E converters 102 and 111 are well known in the prior art, for example these may be any one of the input transducers and output detectors described in the articles by B. Thompson and D. Casasent both appearing in the January 1977 Special Issue on Optical Computing IEEE Proceedings.

The convolver just described puts a filter in the Fourier plane of a lens and is the system used in part to implement the invention systems of FIGS. 1A, 1B, 1C and 3F; the difference being the specific implementation of O/O converter 131 and thereby for implementing real time operation versus the fixed film and addressable filter devices of the prior art. Thus, Fourier analyzer 1, multiplier 5, and inverse Fourier analyzer 6 in clutter filter 10 of FIG. 1A may be lens 103, O/O converter 131, and lens 110 of FIG. 3I. And, the Fourier analyzer, multiplier and inverse Fourier analyzer of FIG. 3F may also be lens 103, O/O converter 131, and lens 110 of FIG. 3I. An example of the realization of a convolver in the prior art is shown in FIG. 4 of the article by J. Goodman appearing in the 1977 Special Issue on Optical Computers Proceedings IEEE while the addressability of prior art filters is discussed in the foregoing article by B. Thompson.

A distinct convolver of the invention, which is particularly suitable for use in a convolver 25 of FIG. 2A, is next shown in FIG. 3I. Convolution is accomplished by inputting electrical signal y to an E/O converter 102 which converts electrical signal y to optical signal y. A multiplier 132, for example the multiplier disclosed previously in FIG. 3B, is utilized to obtain the product of input signals $y(x_1, y_1)$ and $h_r(x_1', y_1')$ where $x_1$, $y_1$ and $x_1'$, $y_1'$ are the spatially unshifted and shifted coordinates of signals y and $h_r$, respectively, i.e., spatially shifting signal $h_r$ with respect to signal y in a two dimensional plane perpendicular to the direction of beam propogation. The product $yh_r$ is inputted to an integrator 133 in which it accumulates over a period of time to form the convolution h in accordance with the first of equations (8). The accumulation of products $yh_r$ in integrator 133 is done by using a shifting means 134 which shifts signal $h_r$ spatially over a period of time corresponding to the integration of integrator 133, the time shifting therefore corresponding to the spatial shifting of coordinates $x_1'$, $y_1'$. Integrator 133 may be the invention optical-to-optical CCD wherein the input signal $yh_r$ is applied to the integrator with a constant reference signal (not shown). Integration is accomplished by filling up the potential wells of the CCD with free carriers. Shift means 134 may implement the spatial shifting of signal $h_r$ mechanically, for example by moving beam combiner 104 in multiplier 132, to obtain shifts $x_1'$, $y_1'$ from positions $x_1$, $y_1$, or may accomplish this same result electrically or optically. An O/E converter 111 may be utilized to convert optical signal h to electrical signal h. Again, converters 102 and 111 are not needed when the original form of signal y and the desired from of signal h are optical.

Integrator 133 and shift means 134 may be a WRITE-READ-ERASE memory of the prior art, for example including erasable memories such as photochromics, thermoplastics, amorphous semiconductors, ferroelectrics, and PLZT ceramics mentioned in the article by W. Kock appearing in the 1977 Special Issue on Optical Computers Proceedings, IEEE, and described in more detail in the foregoing articles by B. Thompson and D. Casasent. In particular, shift means 134 may be the invention optical-to-optical CCD SLM but wherein input signal $h_r(x_1, y_1)$ is shifted electrically by voltage 109 from coordinates $x_1$, $y_1$ to shifted coordinates $x_1'$, $y_1'$ and then outputted as signal $h_r(x_1', y_1')$. This would require first recording signal $h_r(x_1, y_1)$ in CCD 134, second shifting signal $h_r(x_1, y_1)$ to signal $h_r(x_1', y_1')$ in CCD 134, and third reproducing signal $h_r(x_1', y_1')$. Formation of the convolver of FIG. 3I will therefore be obvious to those skilled in the art.

In general, the method of FIG. 3I comprises the steps of optically computing the convolution $h=y*h_r$ of two signals y and x in real time. More specifically, a first method of FIG. 3I comprises the steps of forming signals $S_y$ and $H_r$ from input signals y and x; inputting signals $S_y$ and $H_r$ into a multiplier; forming the product $S_yH_r$; and, forming the convolution h. A second method of FIG. 3I comprises the steps of forming signal $h_r$ from input signals y and x; inputting signal $h_r$ to a delay means; forming shifted signals $h_r(x_1', y_1')$; inputting signals y and $h_r(x_1', y_1')$ to a multiplier; forming the products $yh_r$; inputting products $yh_r$ to an integrator; and integrating products $yh_r$ to obtain the convolution h.

The logical elements just described in FIGS. 3A through 3I can be utilized to form any one of the combinations of the standard systems of FIGS. 1 and 2. For example, Fourier analyzer 1 as described in FIG. 3A, multiplier 5 as described in FIG. 3B, and inverse Fourier analyzer 6 as described in FIG. 3C may be utilized in series with inverse Fourier analyzer 6 in clutter filter 10 of FIG. 1A. In a similar fashion all other combinations appearing in FIGS. 1 and 2 may be realized using one or more of the simple optical devices disclosed in FIGS. 3A through 3I.

It will be recognized by those in the art and many others that the terms "time" and "frequency" as used in Fourier optics in general and as used in the present disclosure in particular refer to the spatial relationships in the front and backplanes of lenses which are related by a Fourier transform. Also, throughout the disclosure the symbol * has been used to indicate the convolution of two signals, for example $y*h_r$ denotes the convolution of signals y and $h_r$, and has also been used to denote the complex conjugate, for example $S_x*$ denotes the complex conjugate of the signal $S_x$, and has been also used to illustrate a conjugate transformer. These meanings for the symbol * should not be confused. The symbol ★ has been used to indicate a correlation, for example $R_{yx}=y★x$ denotes the correlation of signals y and x. Finally, it will be appreciated that while the system of the invention has been disclosed in terms of two signals y and x, the system can also be operated in many applications with the same signal, for example y=x, i.e., by physically connecting input y to input x.

From the foregoing it will be appreciated that, in addition to an uncomplicated and straightforward method, the invention also provides uncomplicated apparatus for optically computing the impulse response h, transfer function H, coherence function $\gamma$, impulse coherence $\Gamma$, a product (for example $S_yH_r$), a division (for example $1/S_x$), the cross correlation $R_{yx}$, cross power spectrum $G_{yx}$, complex conjugate $S_x^*$, and convolution $y^*h_r$ having as inputs one or both signals y and x. Also, it will be appreciated that the on-line optical computer of the present invention can be implemented at any one or more frequencies of the electromagnetic spectrum, for example optically, at IR and, in some applications, at microwave frequencies, or at suitable combinations of frequencies. Thus, it will be appreciated by those in the art and others that various modifications can be made within the scope of the invention. That is, other laser sources than those generating 10.6 and 0.9 microns can be used, that other logical elements than those shown in FIGS. 3A through 3I and particularly of the non-linear elements 107, 107*a*, 107*b*, 107*c*, 118, 119, 125, 127 and 130 can be used to carry out the invention. Hence, the invention can be practiced otherwise than as specifically described herein and providing method and apparatus for optically computing the impulse response h, transfer function H, coherence function $\gamma$, impulse coherence $\Gamma$, product $S_yH_r$, division $1/S_x$, cross correlation $R_{yx}$, cross power spectrum $G_{yx}$, complex conjugate $S_x^*$, and convolution $y^*h_r$ in real time and thereby providing new and improved on-line optical computers.

From the foregoing it can be seen that the present invention implements the parallel-processing optical computer basically as a matched clutter filter and that to obtain the on-line feature a number of logical elements, of FIGS. 3A through 3I, have been disclosed. The invention therefore offers the added benefits of high speed, efficiency, and economy in many applications including pattern recognition and broadband radar analysis. In particular it provides on-line unambiguous determinations of h, H, $\gamma$ and $\Gamma$ whose importance over the more conventional determinations of $R_{yx}$ and $G_{yx}$ have been discussed in the references by Roth and Carter. These important features can now be obtained optically in real time using the new and improved method and apparatus of the present invention. And, while the invention filter has been disclosed primarily as a matched clutter filter it will be obvious to use the apparatus and method of the invention to implement a general transfer function $H_r$ and response H.

In summary, the present invention provides apparatus and method for optically computing the functions H, h, $\gamma$ and $\Gamma$, as shown by way of example in FIGS. 1 and 2 comprising optical elements, shown by way of example in FIG. 3. In general, the various matched clutter filter functions $H_r$ have been given in the discussion of equations (9) through (13) and it has been subsequently shown that the matched clutter filter when based on H and h is useful when the interference resembles the input signal x and, when based on $\Gamma$ and $\gamma$ is useful when the interference resembles the product of signals x and y. Filters of FIGS. 1A, 1B, 2A, 2B are stand-alone from filters 1C and 2C, i.e., if H and h are needed one uses the former filters while if $\Gamma$ and $\gamma$ are needed one uses the latter filters.

The specification of optical structure which may be necessary to tie the various elements and components together is also a straightforward matter in the art and no undue amount of experimentation would therefore be required. The disclosed block diagrams of the invention filters in FIGS. 1 and 2 show all interconnections and with each block's optical assemblage shown in FIG. 3 so that the full specification of the blocks and interconnections will be obvious to those current in the art, i.e., the blocks and interconnections are optical for the most part and once block functions and contents are known it is a routine matter by one skilled in the art to tie the elements and blocks together, for example as is routinely done by K. Preston, G. Stroke and in the 1975 and 1977 Special Issues on Optical Computers IEEE. Thus, the structure disclosed in FIGS. 1–3 can be implemented using elements disclosed or using elements known in the prior art and following routine interconnections of elements known in the prior art. For example, FIG. 2A shows means 4 and inverse Fourier analyzer 24 having input signal x and providing output signal $h_r$, convolver 25 having input signals y, $h_r$ and providing output signal h, and Fourier analyzer means 26 having input signal h and providing output signal H. As shown in FIG. 1A, means 4 in FIG. 2A comprises means 2 having input signal x and providing output signal $S_x$ and means 3 having input signal $S_x$ and providing output signal $H_r$. Means 3, in the form of FIG. 3G, comprises conjugate transformer 112 having input $S_x$ and providing at its output signal $S_x^*$ and negative non-linear element 113 having input signal $S_x^*$ and providing at its output signal $1/S_x$.

Means 4 can therefore be implemented as the Fourier analyzer of FIG. 3A (if signal x is optical only lens 103 is needed), coupled in sequence to the inverter of FIG. 3G (conjugate transformer 112 as in FIG. 3D), and means 24 as the inverse Fourier analyzer of FIG. 3C (since signal $H_r$ is optical only lens 110 is needed), while convolver 25 can be implemented as the convolver of FIG. 3I. Moreover, the interconnections between boxes of computer 40 are optical (the input and output signals may be electrical or optical as desired) so that the optical alignment of known elements in the combinations disclosed is all that is needed. The optical interconnections and alignment of elements of FIGS. 3A, 3B, 3C, 3D to form the boxes, interconnections and alignments of the boxes of FIG. 2A is therefore a straightforward matter and can be routinely done by one skilled in the art.

By way of a specific alignment example, consider the multiplication of spectra $S_y$ and $H_r$. If beams $S_y$ and $H_r$ are made to fall on a single non-linear element replacing the film of conventional holography, the alignment procedure follows the well known Leith-Upatnieks method used to separate beams of holography. First, the non-linear element records $H_rA^*$ where A is a constant reference beam. Next, the non-linear element is illuminated by $S_y$ to obtain, except for a constant, the product $S_yH_r$. If, on the other hand, beams $S_y$ and $H_r$ are inputted to the parallel processor of FIG. 3B, then it is necessary to align amplitude transmittances (non-linear elements) 107*a* and 107*c* and phase transmittance (non-linear element) 107*b* with the various beam combiners as shown or, alternatively, without beam combiners, i.e., holographically. Thus, whether implemented as a holographic or parallel processor, the alignment care which is needed to build the invention computer is a well known procedure of the prior art using film. It is to be expected therefore that the alignment care which is needed to build the invention computer will follow closely the procedures used in the prior art. It will be appreciated that the present state of art of optical computers is carried out in well equipped laboratories and by skilled persons who may be expected to exercise the care which is common to their art.

Optical computing per se is not new and several prior art publications have been identified previously showing optical block diagrams, interconnections and alignments of elements. Reference may be made to these and to the general art on optical computing for detailed information on how to interconnect and align components. Thus, the invention apparatus can be routinely tied together following standard procedures of the prior art with conclusion that the specific disclosure of optical interconnection and alignment structure is no more difficult than is specific disclosure of electrical interconnection structures in a circuit diagram. This is not saying that optical interconnections and alignments are as easy to make as are electrical ones but merely to state the fact that the optical art provides known procedure for making same so that no undue experimentation would be required to build optical computers including the invention computers, for example as is done routinely when building the optical computers in the foregoing references.

Unlike electrical computers, the task of building optical computers is now confined to the laboratory. However, the field of optical computers is quite active at the present time. This can all be seen in the January, 1977 Special Issue on Optical Computing IEEE Proceedings. This important and pertinent reference shows the present state of the art and also shows how block diagrams of optical computers may be interconnected and aligned in practice.

In many applications it is desirable to combine the extremely high speed of optical computation with its operation in real time. Such applications might require operations which include matched clutter filtering of one and two dimensional signal processing, echo ranging, coherent communications systems, convolution, correlation, pattern recognition, microscopy, medical electronics, and general clutter filtering for linear and quadratic transformations on data vectors. The optical computer when implemented as a clutter filter is a special purpose analog computer which performs operations at rates far in excess of the capabilities of large general and special purpose digital computers, electronic analog computers, and analog computation using acoustical excitation. Its applications include and are well suited for the detection, resolution, and identification of one and two-dimensional signals and the quantitative determination of their relationships and causality. Options for the implementation of clutter filters include, of course, the general and special purpose digital computers and analog computers based on electronics and acoustic techniques, their full potential being limited by their lack of speed, throughput capacity, efficiency, and economic availability of hardware. The present invention offers outstanding practical implementations of on-line optical computing and should find use in such one and two-dimensional signal processing tasks as system identification, signal identification, bit synchronization, error correction, pulse compression, earthquake signal analysis, medical signal analysis, microscopy, fingerprint identification, word recognition, chromosome spread detection, earth-resources and land-use analysis, satellite mapping, surveillance, and reconnaissance data processing, and in such diverse systems as radar, sonar, communications, and computer systems, and so forth. In particular, the present invention provides extremely high speed means for the computation of the impulse response h, transfer function H, coherence function $\gamma$, and impulse coherence $\Gamma$ of signals y and x thereby further extending the speed, efficiency and economic availability of optical computers. As a consequence, the system of the present invention is expected to make substantial improvements in the performance of such devices and corresponding reductions in the complexity and cost of detecting and identifying one and two dimensional signals, i.e., in the speedup of operation and lowering of weights, sizes, power consumption, and costs of radars, sonars, communication systems, test instruments, and so forth.

Although a number of configurations of optical computers have been described, it should be understood that the scope of the invention should not be considered to be limited by the particular embodiments of the invention shown by way of illustration but rather by the appendant claims.

I claim:

1. A system for optical real time analog computation by manipulating optical signals in two spatial dimensions simultaneously, including in combination:

first and second terminal means for coupling beam signals, respectively, as inputs;

optical computation means;

first means for coupling said first terminal means to said computation means as an input;

second means for coupling said second terminal means to said computation means as an input;

said computation means having the outputs of said first and second coupling means as inputs and providing a mathematical relationship of its inputs, as an output, said computation means including at least one spatial light modulator (SLM) for recording first input images and for reproducing output images when illuminated by second input images, said SLM including a free carrier source for recording and reproducing optical images by forming charges in potential wells created by applying voltages to electrodes in said free carrier source.

2. A system as defined in claim 1 wherein said free carrier source is a charge coupled device (CCD).

3. A system as defined in claim 1 wherein said first and second images are from said second and first coupling means, respectively.

4. A system as defined in claim 1 wherein said recording of said first images is made with the assistance of a reference beam.

5. A system as defined in claim 1 wherein said recordings of said first images is one of amplitude, phase, amplitude and phase, and intensity recordings.

6. A system as defined in claim 1 wherein the reproducing of images is at wavelengths and times different from the recording wavelengths and times.

7. A system as defined in claim 1 wherein said SLM is one of a divider, multiplier, convolver, conjugate transformer, non-linear element, inverter, spatial shifter, and integrator.

8. A system as defined in claim 7 wherein said divider comprises:

a multiplier unit;

at least one inverter unit having input from said second means and providing output to said multiplier unit; and means for coupling the output of said inverter units as input to said multiplier unit, said multiplier unit having as input the signals from said first coupling means and inverter units and providing as output the signal from said first coupling means divided by the signals from said second coupling means.

9. A system as defined in claim 7 wherein said divider comprises:

a first SLM having as input the signals $S_y$ and $S_x$ from said first and second coupling means, said first SLM having transmittance $1/|S_x|$ and providing as output the signal $S_y/|S_x|$;

a second SLM having as input the signals $S_x$ and $S_x$ from said second coupling means, said second SLM having transmittance $1/|S_x|$ and providing as output the signal $|S_x|/S_x=e^{-j\phi}$; and a third SLM having as input the outputs of said first and second SLMs, said third SLM having transmittance $e^{-j\phi}$ and providing as output the signal $S_y/S_x$.

10. A system as defined in claim 7 wherein said convolver includes a multiplier unit having said first and second terminal means coupled thereto as inputs, said multiplier unit having as input signals $S_y$ and $H_r$ from said first and second means and providing as output the product $S_yH_r$.

11. A system as defined in claim 7 wherein said convolver comprises:

a multiplier unit, said first and second coupling means for coupling said first and second terminal means to said multiplier as input;

means included in said second coupling means for spatially shifting said input signals relative to each other; and an integrator having the output of said multiplier unit as input and providing as output the convolution of signals from said first and second coupling means.

12. A system as defined in claim 11 wherein said integrator is a WRITE-READ-ERASE optical memory.

13. A system as defined in claim 11 wherein said shifting means is one of a mechanical, electrical and optical means for spatially shifting said input signals to said multiplier unit.

14. A system as defined in claim 11 wherein said shifting means is a charge coupled device (CCD) for spatially shifting said input signals.

15. A system as defined in claim 7 wherein said multiplier comprises:

a SLM having as input the signals $S_y$ and $H_r$ from said first and second coupling means and providing as output the signal $S_yH_r$.

16. A system as defined in claim 7 wherein said multiplier comprises:

a first SLM having as input the signals $S_y$ and $H_r$ from said first and second coupling means and inverter units, said first SLM having transmittance $|H_r|$ and providing as output the signal $S_y\,|H_r|$;

a second SLM having as input the signals $H_r$ and $H_r$ from said second coupling means, said second SLM having transmittance $1/|H_r|$ and providing as output the signal $H_r/|H_r|=e^{j\phi}$; and a third SLM having as input the outputs of said first and second SLMs, said third SLM having transmittance $e^{j\phi}$ and providing as output the signal $S_yH_r$.

17. A system as defined in claim 7 including a conjugate transformer SLM coupled between said second coupling means and said multiplier, said conjugate transformer having as input the signal $S_x$ from said second coupling means and providing as output the signal $S_x^*$, said multiplier having as input the signals $S_y$ and $S_x^*$ from said first coupling means and conjugate transformer, respectively, and providing as output the signal $S_yS_x^*$.

18. A system as defined in claim 7 wherein said optical conjugate transformer comprises:

a first SLM having as input signals $S_x$ and $S_x$ from said first and second coupling means, said first SLM having transmittance $1/|S_x|$ and providing as output the signal $|S_x|/S_x=e^{-j\phi}$; and a second SLM having as input signal $S_x$ from said second coupling means and the output from said first SLM, said second SLM having transmittance $|S_x|$ and providing as output the signal $S_x^*=|S_x|e^{-j\phi}$.

19. A system as defined in claim 7 wherein said non-linear element comprises:

a SLM having as input signal $S_x^*$ and $S_x^*$ from said first and second coupling means, said SLM having transmittance $1/|S_x|^2$ and providing as output the signal $1/S_x$, said non-linear element being therefore a negative non-linear element.

20. A system as defined in claim 7 wherein said inverter comprises an optical conjugate transformer and negative non-linear element SLMs coupled in sequence.

21. A system as defined in claim 7 wherein the spatial shifter includes shifting means for spatially shifting recorded first images prior to reproducing output images.

22. A system as defined in claim 7 wherein the integrator includes integrating means for integrating recorded first images prior to reproducing output images.

23. A system as defined in claim 1 wherein said first coupling means and said second coupling means include Fourier analyzers.

24. A system as defined in claim 1 wherein said first coupling means includes a power spectrum analyzer and means for coupling said second terminal means to said power spectrum analyzer as input, and wherein said second coupling means includes a power spectrum analyzer.

25. A system as defined in claim 1 wherein said first coupling means includes a first power spectrum analyzer and squarer coupled in sequence, and wherein said second coupling means includes: second and third power spectrum analyzers;

means for coupling said second terminal means to said first and third power spectrum analyzers; and means for coupling the outputs of said second and third power spectrum analyzers to a common output; and wherein said first coupling means further includes means for coupling said first terminal means to said second power spectrum analyzer as input.

26. A system as defined in claim 1 including an inverse Fourier analyzer, and means for coupling the output of said computation means to said inverse Fourier analyzer.

27. A system as defined in claim 1 wherein said first coupling means is a beam of light and wherein said second coupling means is a Fourier analyzer, inverter and inverse Fourier analyzer coupled in sequence.

28. A system as defined in claim 1 wherein said first coupling means includes a correlator and means for coupling said second terminal means to said correlator as input, and wherein said second coupling means is a power spectrum analyzer, inverter and inverse Fourier analyzer coupled in sequence.

29. A system as defined in claim 1 wherein said first coupling means includes a power spectrum analyzer, squarer and inverse Fourier analyzer coupled in sequence and means for coupling said second terminal means to said power spectrum analyzer as input, and wherein said second coupling means includes:

first and second power spectrum analyzer and inverter units coupled in sequence, and means for coupling said first terminal means to said first power spectrum analyzer and inverter; and a second multiplier having as input the outputs from said first and second inverter units, with the output thereof coupled as input to an inverse Fourier analyzer whose output in turn is coupled as input to said computation means.

30. A system as defined in claim 1 including a Fourier analyzer, and means for coupling the output of said computation means as input to said Fourier analyzer.

31. A method of optical real time analog computation by manipulating optical signals in two spatial dimensions simultaneously including the steps of;

coupling beam signals from first and second sources as inputs to an optical computation unit having a spatial light modulator (SLM);

recording first optical images in the SLM and reproducing output optical images from the SLM by illuminating the SLM with second optical images;

said recording and reproducing steps including applying voltages to a free carrier source in the SLM, and forming charges in potential wells in the free carrier source, whereby two dimensional optical images are recorded and reproduced from the free carrier source; and providing a mathematical relationship of inputs as outputs from said computation unit.

32. The method of claim 31 including the step of including as SLM a charge coupled device (CCD) free carrier source 33. The method of claim 31 including the step of coupling said first and second images from said second and first sources, respectively.

34. The method of claim 31 including the step of recording said first images with the assistance of a recording beam.

35. The method of claim 31 including the step of recording one of amplitude, phase, amplitude and phase, and intensity recordings.

36. The method of claim 31 including the step of reproducing images at wavelengths and times different from the recording wavelengths and times.

37. The method of claim 31 including the step of including in said SLM one of a multiplier, convolver, conjugate transformer, non-linear element, inverter, spatial shifter, and integrator.

38. The method of claim 37 including the steps of:

including in said convolver a multiplier;

coupling said first and second coupling means to said multiplier as input; and multiplying signals $S_y$ and $H_r$ from said first and second coupling means to obtain the product $S_yH_r$.

39. The method of claim 37 including the steps of;

including in said convolver a multiplier, shifter and integrator units;

coupling said first and second coupling means to said multiplier as input;

spatially shifting said input signals to said multiplier relative to each other;

multiplying said input signals in said multiplier; and integrating the output of said multiplier unit to obtain the convolution of signals from said first and second coupling means.

40. The method of claim 39 including the step of integrating in a WRITE-READ-ERASE memory integrator unit.

41. The method of claim 39 including the step of shifting in a charge coupled device (CCD).

42. The method of claim 41 including the steps of:

recording one input signal at first coordinates in said CCD;

shifting said CCD record from said first to second coordinates; and reproducing said CCD record at second coordinates.

43. The method of claim 37 including the step of including in said multiplier a single SLM having as input the signals $S_y$ and $H_r$ from said first and second coupling means and providing as output the signal $S_yH_r$.

44. The method of claim 37 including the step of including in said multiplier a first SLM having as input signals $S_y$ and $H_r$ from said first and second coupling means, said first SLM having transmittance $|H_r|$ and providing as output the signal $S_y|H_r|$;

a second SLM having as input the signal $H_r$ and $H_r$ from said second coupling means, said second SLM having transmittance $1/|H_4|$ and providing as output the signal $|H_r|/H_r=e^{-j\phi}$; and a third SLM having as input the outputs of said first and second SLMs, said third SLM having transmittance $e^{-j\phi}$ and providing as output the signal $S_yH_r$.

45. The method of claim 37 including the steps of:

coupling a conjugate transformer SLM between said second coupling means and said multiplier;

providing as output the signal $S_x^*$ from said conjugate transformer having as input the signal $S_x$ from said second coupling means; and providing as output the signal $S_yS_x^*$ from said multiplier having as input the signals $S_y$ and $S_x^*$ from said first coupling means and conjugate transformer.

46. The method of claim 37 including the step of including in said conjugate transformer:

a first SLM having as input signals $S_x$ and $S_x$ from said first and second coupling means, said first SLM having transmittance $1/|S_x|$ and providing as output the signal $|S_x|/S_x=e^{-j\phi}$; and a second SLM having as input signal $S_x$ from said second coupling means and the output from said first SLM, said second SLM having transmittance $|S_x|$ and providing as output the signal $S_x^*=|S_x|e^{-j\phi}$.

47. The method of claim 37 including the step of including in said non-linear element a SLM having as input signals $S_x^*$ and $S_x^*$ from said first and second sources, said SLM having transmittance $1/|S_x|^2$ and providing as output the signal $1/S_x$.

48. The method of claim 37 including the step of including in said inverter an optical conjugate transformer and negative non-linear element SLMs coupled in sequence.

49. The method of claim 37 including the step of spatially shifting recorded first images prior to reproducing output images.

50. The method of claim 37 including the step of integrating recorded first images prior to reproducing output images.

51. The method of claim 31 including the step of reproducing a division by inverting the signal from the second source and multiplying the inverted signal with the signal from the first source.

52. The method of claim 31 including the step of reproducing a division by forming the signal $S_y/|S_x|$ using a first SLM having transmittance $1/|S_x|$;

forming the signal $|S_x|/S_x=e^{-j\phi}$ using a second SLM having transmittance $1/|S_x|$; and forming the signal $S_y/S_x$ using a third SLM having transmittance $e^{-j\phi}$.

53. The method of claim 31 including the step of coupling the output of said computation unit to an inverse Fourier analyzer.

54. The method of claim 31 including the step of coupling the output of said computation unit to a Fourier analyzer.

* * * * *